US007926434B2

(12) United States Patent
Hanada

(10) Patent No.: US 7,926,434 B2
(45) Date of Patent: Apr. 19, 2011

(54) THREAD CUTTING DEVICE OF SEWING MACHINE

(75) Inventor: Tsuyoshi Hanada, Tokyo (JP)

(73) Assignee: Juki Corporation, Chofu-shi, Tokyo (JP)

( * ) Notice: Subject to any disclaimer, the term of this patent is extended or adjusted under 35 U.S.C. 154(b) by 378 days.

(21) Appl. No.: 12/205,076

(22) Filed: Sep. 5, 2008

(65) Prior Publication Data

US 2009/0071385 A1 Mar. 19, 2009

(30) Foreign Application Priority Data

Sep. 6, 2007 (JP) ..... P. 2007-231438

(51) Int. Cl.
*D05B 65/00* (2006.01)
*D05B 37/04* (2006.01)

(52) U.S. Cl. ..... 112/292

(58) Field of Classification Search ..... 112/285–301, 112/302, 274, 197; 83/578, 698.71, 699.11, 83/856, 910, 936
See application file for complete search history.

(56) References Cited

U.S. PATENT DOCUMENTS 4,365,568 A * 12/1982 Ross ..... 112/291
5,417,173 A * 5/1995 Mitsuji ..... 112/475.01
5,722,338 A * 3/1998 Douyasu ..... 112/475.17
5,964,170 A * 10/1999 Gries ..... 112/291
7,497,177 B2 * 3/2009 Tanaka et al. ..... 112/292
7,603,957 B2 * 10/2009 Shiraishi ..... 112/298
2008/0250995 A1 * 10/2008 Hanada ..... 112/285
2009/0211505 A1 * 8/2009 Hanada ..... 112/292

FOREIGN PATENT DOCUMENTS

JP 3106472 9/2000
JP 2008-086596 4/2008
JP 2008-086598 4/2008

* cited by examiner

*Primary Examiner* — Ismael Izaguirre
(74) *Attorney, Agent, or Firm* — Drinker Biddle & Reath LLP

(57) ABSTRACT

A thread cutting device of a sewing machine cuts a thread below a throat plate through which a needle is inserted. The thread cutting device includes a first thread catcher operable to catch the thread, a second thread catcher operable to catch the thread caught by the first thread catcher, a fixed blade operable to cut the thread caught by the second thread catcher, a driving portion which drives the first thread catcher and the second thread catcher such that the second thread catcher catches the thread caught by the first thread catcher and guides the thread toward the fixed blade, an attaching member to which the fixed blade is fixed and into which the second thread catcher is slidably inserted from above over the fixed blade, and a cover which covers the second thread catcher from above to restrict an upward movement of the second thread catcher.

6 Claims, 19 Drawing Sheets

THREAD CUTTING DEVICE OF SEWING MACHINE

CROSS-REFERENCE TO RELATED APPLICATION

The present application claims priority from Japanese Patent Application No. 2007-231438 filed on Sep. 6, 2007, the entire content of which is incorporated herein by reference.

FIELD OF INVENTION

The present invention relates to a thread cutting device of a sewing machine which guides a thread caught by a thread catcher toward a fixed blade to cut the thread.

DESCRIPTION OF RELATED ART

A related art thread cutting device cuts an upper thread and a lower thread extending from a horizontal shuttle at the end of sewing operation (see e.g., JP 3106472 B2). The thread cutting device is provided inside a bed portion of a sewing machine, and includes a thread catcher which is moved back and forth by obtaining power from a lower shaft driven by a sewing machine motor. The thread catcher has a thread catching portion on its tip end portion. The thread catcher catches the upper thread and the lower thread at the thread catching portion during its backward movement, and guides the threads to the fixed blade to cut them.

FIG. 21 shows an example of a related art thread cutting device. As shown in FIG. 21, a fixed blade 700 (the fixed blade) is held by a fixed blade holding member 701. The fixed blade holding member 701 is fixed on an upper surface of an attaching member 702 which is attached to a frame of a sewing machine. The fixed blade holding member 701 and the attaching member 702 are formed with insertion holes through which a thread catcher 703 is slidably inserted. The thread catcher 703 catches a thread extending between a needle eye and a horizontal shuttle. In order to prevent the thread catcher 703 from dropping out of the fixed blade holding member 701 and the attaching member 702, a stopper 704 such as an E ring or the like which is larger than a width of the insertion holes is attached to the thread catcher 703 such that the stopper 704 and the thread catcher 703 sandwich the fixed blade holding member 701 and the attaching member 702 therebetween.

In the configuration described above, when replacing the fixed blade 700 due to abrasion or breakage, the thread catcher 703 needs to be removed. However, because the thread catcher 703 is attached to sandwich the fixed blade holding member 701 and the attaching member 702 together with the stopper 704, the entire unit including these components needs to be removed in order to replace the fixed blade 700. Therefore, a replacement of the fixed blade 700 has been a complicated and onerous work.

SUMMARY OF INVENTION

It is an object of the present invention to provide a thread cutting device of a sewing machine in which a fixed blade can be easily replaced.

According to an embodiment of the present invention, a thread cutting device of a sewing machine cuts a thread below a throat plate through which a needle is inserted. The thread cutting device includes a first thread catcher operable to catch the thread, a second thread catcher operable to catch the thread that is caught by the first thread catcher, a fixed blade operable to cut the thread that is caught by the second thread catcher, a driving portion which drives the first thread catcher and the second thread catcher such that the second thread catcher catches the thread that is caught by the first thread catcher and guides the thread toward the fixed blade, an attaching member with respect to which the fixed blade is fixed and into which the second thread catcher is slidably inserted from above over the fixed blade, and a cover which covers the second thread catcher from above so as to restrict an upward movement of the second thread catcher.

Other aspects and advantages of the invention will be apparent from the following description, the drawings and the claims.

DETAILED DESCRIPTION

Figure 1:
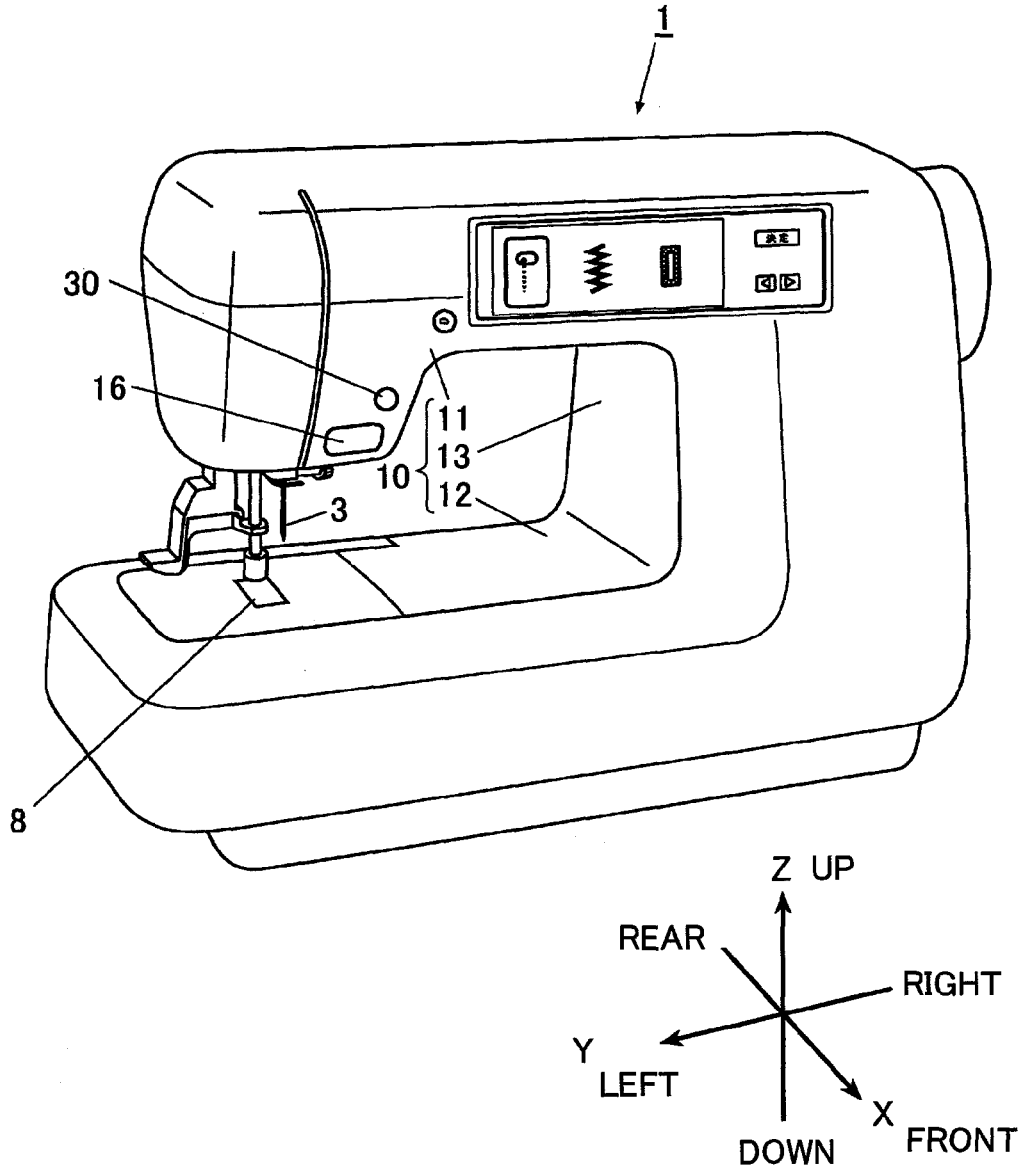
FIG. 1 is a schematic perspective view of a sewing machine according to an embodiment of the present invention.

Hereinafter, an embodiment of the present invention will be described in detail with reference to the drawings. The following embodiment does not limit the scope of the present invention. In the following description, orientations of respective components of the sewing machine are defined based on XYZ axes shown in the drawings.

A sewing machine 1 according to the embodiment is a household sewing machine for pattern sewing. The sewing machine 1 performs pattern sewing by, based on pattern data or a pattern sewing cam, feeding a cloth in a forward and reverse direction along a cloth feeding direction at a given feeding pitch while swinging a needle in a direction orthogonal to the cloth feeding direction.

The sewing machine 1 includes a frame 10 having an arm 11, a bed portion 12 and a vertical drum portion 13, a sewing machine motor 5 (see FIG. 7) serving as a drive source, a needle 3 which moves up and down interlockingly with the sewing machine motor 5, a shuttle mechanism 20 (see FIG. 5) which moves interlockingly with the sewing machine motor 5 to forms stitches in cooperation with the needle 3, a sewing machine thread cutting device 100 (see FIGS. 2 and 5) disposed inside the bed portion 12, an upper shaft (a main shaft) which is rotated by the sewing machine motor 5, a main shaft position detecting sensor 7 (see FIG. 11) which detects a certain position (e.g., an upper position) in one rotation of the upper shaft, and a controller 50 (see FIG. 11) which controls an operation of the sewing machine motor 5.

The sewing machine 1 further includes a start-stop switch 16 from which start and stop of the sewing operation of the sewing machine 1 is input, a pattern selecting switch 17 from which a pattern to be sewn is selected, a speed setting portion 18 from which a stitching speed is set, a needle bar swinging stepping motor 90 serving as a drive source of needle swinging, a feed dog driving stepping motor 91 serving as a drive source of cloth feeding, and a selected pattern display 92 (e.g., a liquid crystal display panel) which displays a selected pattern to be sewn.

Inside the arm 11, the sewing machine 5 is coupled to the upper shaft, and the upper shaft is provided so as to be rotatable around a Y axis direction. A thread cutting switch 30 from which a start of a thread cutting is input is arranged on a tip end portion of the arm 11.

On the other hand, inside the bed portion 12, a lower shaft 2 coupled to the upper shaft is rotatably provided. In this embodiment, the rotational speed of the upper shaft and the rotational speed of the lower shaft 2 are the same so that the rotational angle of the upper shaft and the rotational angle of the lower shaft correspond to each other. A throat plate 8 having a needle hole 9 through which the needle 3 penetrates is disposed on an upper surface portion of the bed portion 12.

Figure 5:
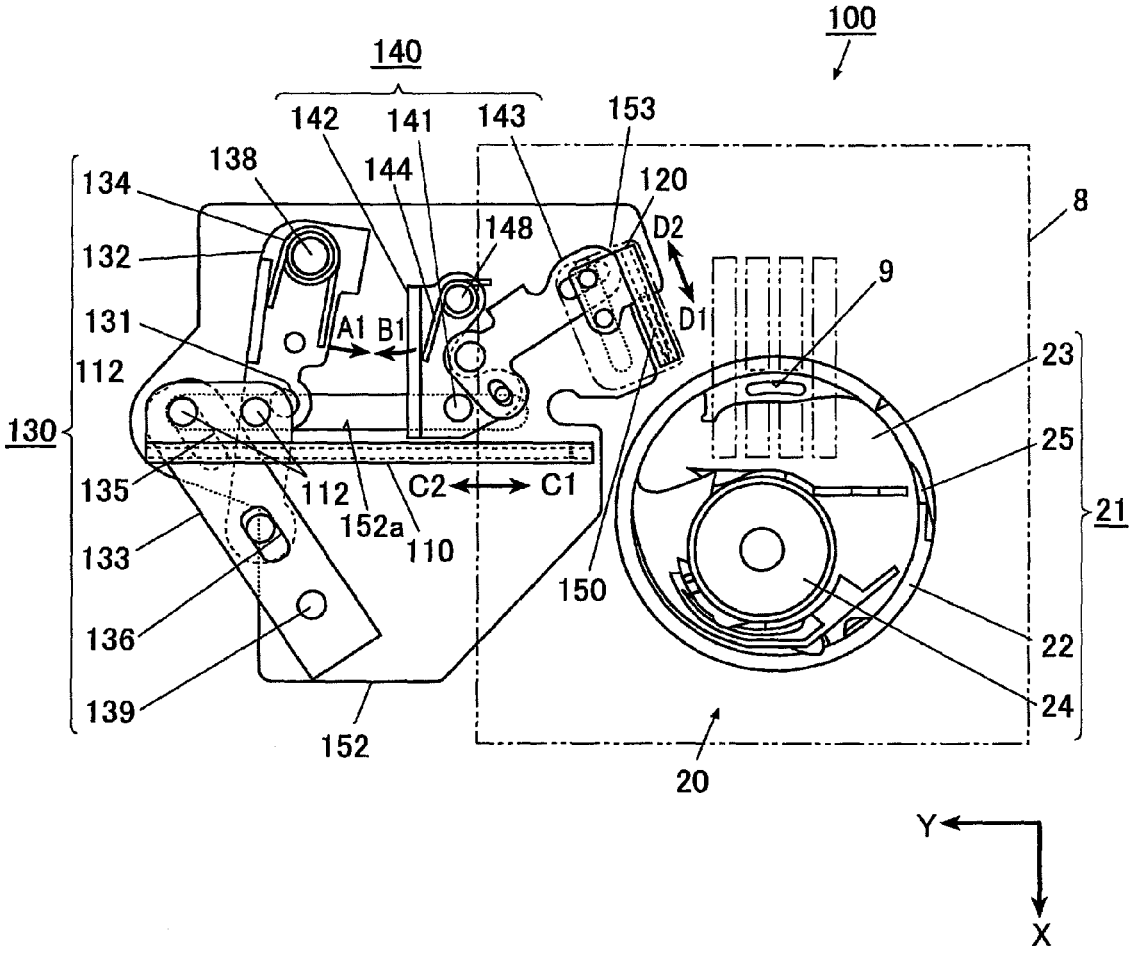
FIG. 5 is a plan view of the thread cutting device.

As shown in FIG. 5, the shuttle mechanism 20 is disposed below the throat plate 8, and includes a horizontal shuttle 21 which rotates around a vertical axis line. The horizontal shuttle 21 includes an outer shuttle 22 which rotates by obtaining power from the lower shaft 2, and an inner shuttle 23 which is disposed inside the outer shuttle 22 and does not rotate. The outer shuttle 22 rotates at a rotational speed which is twice as high as the rotational speed of the upper shaft and the lower shaft 2, i.e. rotates with a double rotation number. The outer shuttle 22 includes a hook 25, and the hook 25 catches a loop of an upper thread during an upward movement of the needle 3 penetrating through the needle hole 9. A bobbin 24 around which a lower thread is wound is attached inside the inner shuttle 23.

The cutting device 100 cuts at least one of the upper thread and the lower thread between the horizontal shuttle 21 and the needle hole 9 (hereinafter, a thread T). As shown in FIGS. 2 to 6C, the thread cutting device 100 includes a first thread catcher 110 which moves back and forth below the throat plate 8 to catch the thread T, a second thread catcher 120 which catches the thread T caught by the first thread catcher 110 and guides the thread T to a fixed blade 150 (fixed blade) to cut the thread T, a fixed blade holding member 151 which holds the fixed blade 150, an attaching plate 152 (an attaching member) into which the second thread catcher 120 is slidably fitted from above the fixed blade 150 such that the second thread catcher 120 movable toward and away with respect to the horizontal shuttle 21, a cover 153 which downwardly holds the second thread catcher 120 above the fixed blade 150, and a driving portion 200 which makes the second thread catcher 120 perform a catching operation and a cutting operation after the catching operation of the first thread catcher 110.

Figure 2:
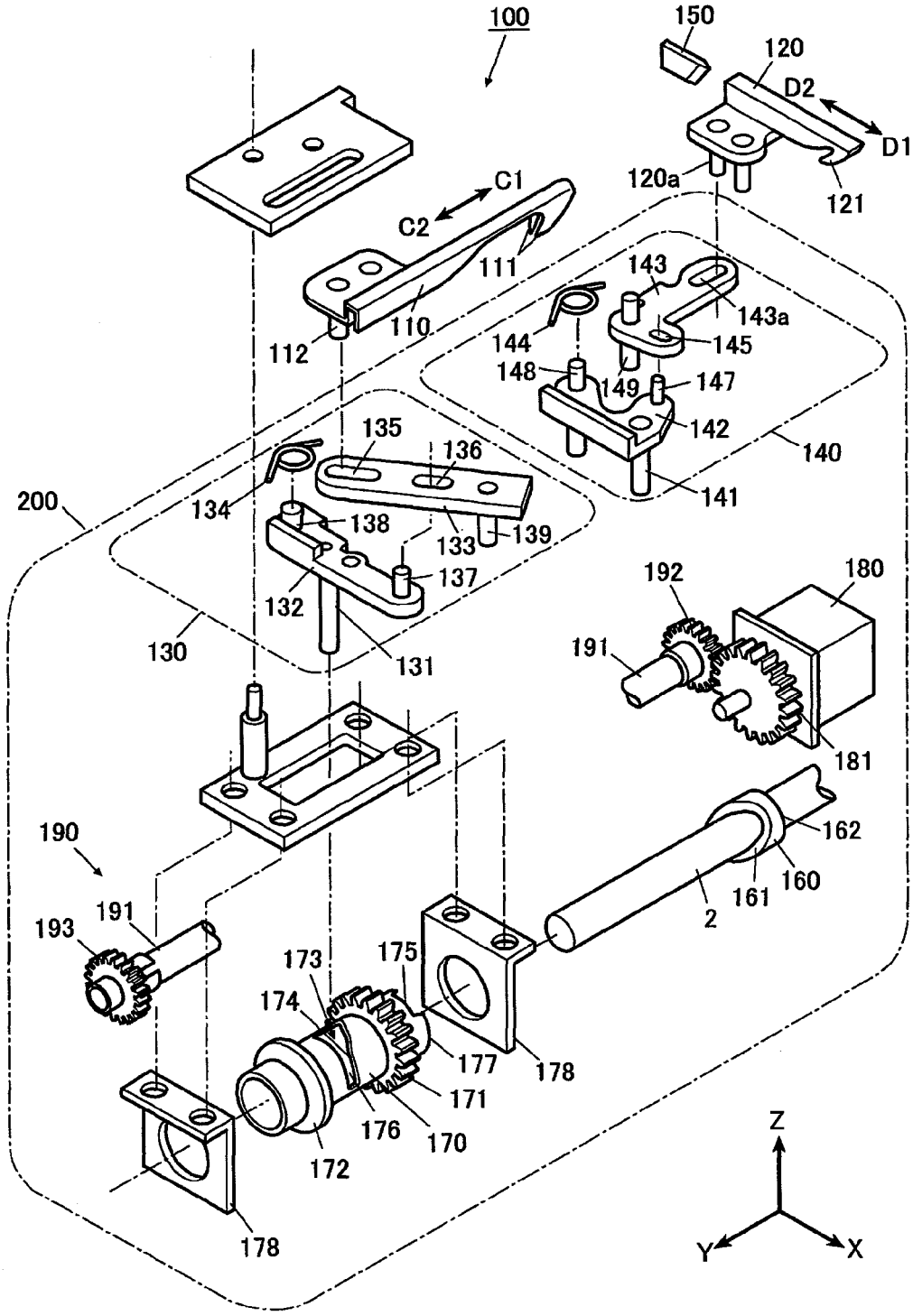
FIG. 2 is an exploded perspective view of a thread cutting device of the sewing machine.
Figure 6A:
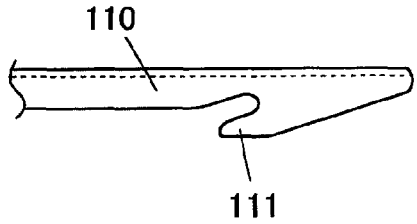
FIG. 6A is a side view of a portion of a first thread catcher.

As shown in FIGS. 2 and 6A, the first thread catcher 110 has, on its tip end portion, a first thread catching portion 111 having a hook-shape which is bent toward the rear side C2 in its back and forth movement. The first thread catcher 110 catches the thread T with the first thread catching portion 111 by moving back and forth (a linear reciprocation) in a longitudinal direction of the lower shaft 2 (i.e. in a Y-axis direction) along a rail (not shown) in accordance with a first link mechanism 130 of the driving portion 200. While the first thread catching portion 111 is forked in this embodiment (see FIG. 2), it may be formed as a single hook. Alongside the first thread catcher 110, a clamp member (not shown) is provided. When the first thread catcher 110 is in an initial state, i.e., when the first thread catcher 110 is at the rearmost position, the clamp member is brought into contact with a side surface of the first thread catching portion 111 and holds the thread T that has been cut. A base end portion of the first thread catcher 110 is formed with two pins 112 extending substantially orthogonal to a direction in which the first thread catcher 110 extends.

Like the first thread catcher 110, the second thread catcher 120 has, on its tip end portion, a second thread catching portion 111 having a hook-shape which is bent toward the rear side D2 in its back and forth movement. The second thread catching portion 111 catches the thread T which extends between the first thread catching portion 111 and the needle hole 9 after being caught by the first thread catcher 110 (see FIG. 20). The second thread catcher 120 is arranged at a position near a stitching point where the second thread catching portion 111 can intersect, in a plan view, with the thread T extending between the first thread catching portion 111 of the first thread catcher 110 and the needle hole 9 by moving back and forth (a linear reciprocation) along a rail (not shown) in accordance with a second link mechanism 140 of the driving portion 200 (see FIG. 20).

Figure 6B:
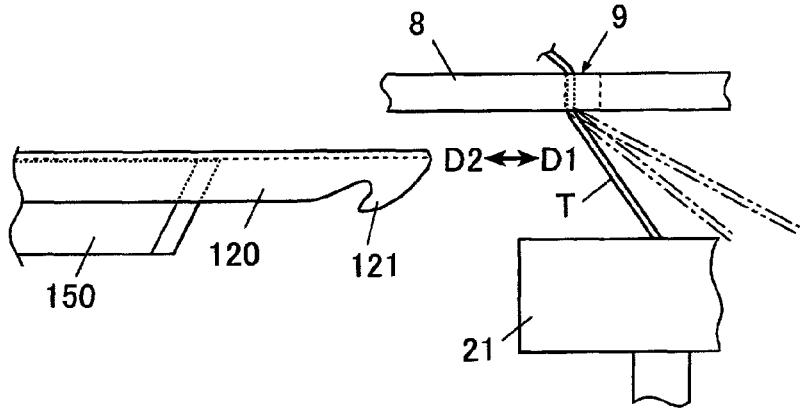
FIG. 6B is a schematic view illustrating a heightwise relationship of a second thread catcher, the fixed blade, a throat plate, a horizontal shuttle, and a sewing thread.

The second thread catcher 120 moves at a height at which it can catch the thread T extending between the first thread catching portion 111 of the first thread catcher 110 and the needle hole 9. As shown in FIG. 6B, the second thread catcher 120 is formed such that a front end thereof is made sharp toward the upper side close to the throat plate 8. The second thread catcher 120 moves such that the front end passes between the thread T caught by the first thread catching portion 111 and the throat plate 8.

Figure 6C:
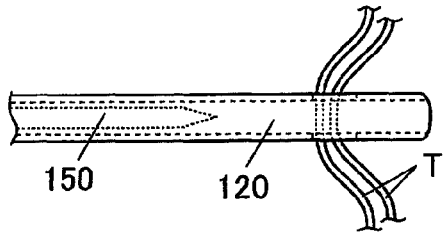
FIG. 6C is a plan view of the second thread catcher and the fixed blade.

The second thread catcher 120, including the second thread catching portion 111, is formed with a forked portion downwardly extending in parallel along a longitudinal direction (see FIGS. 5 and 6C). The fixed blade 150 is arranged on an inner of this forked portion such that its blade tip is oriented in a forward moving direction of the second thread catcher 120 is (see FIGS. 6B and 6C). The second thread catcher 120 is moved back and forth by the driving portion 200 to perform the linear reciprocation along the fixed blade 150, thereby guiding the thread T caught by the second thread catching portion 111 toward the fixed blade 150 to cut the thread T.

Figure 3:
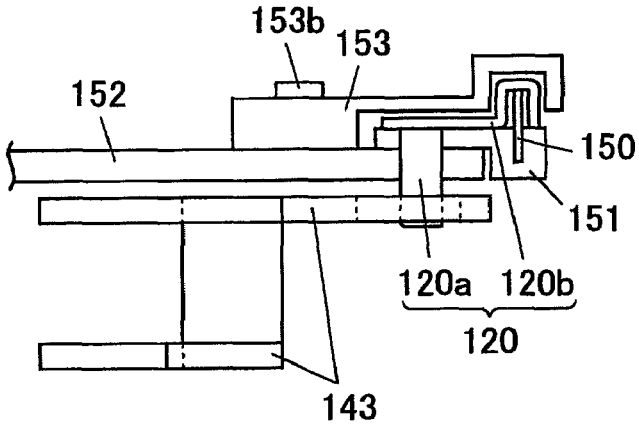
FIG. 3 is a side view of a configuration around a fixed blade.
Figure 4:
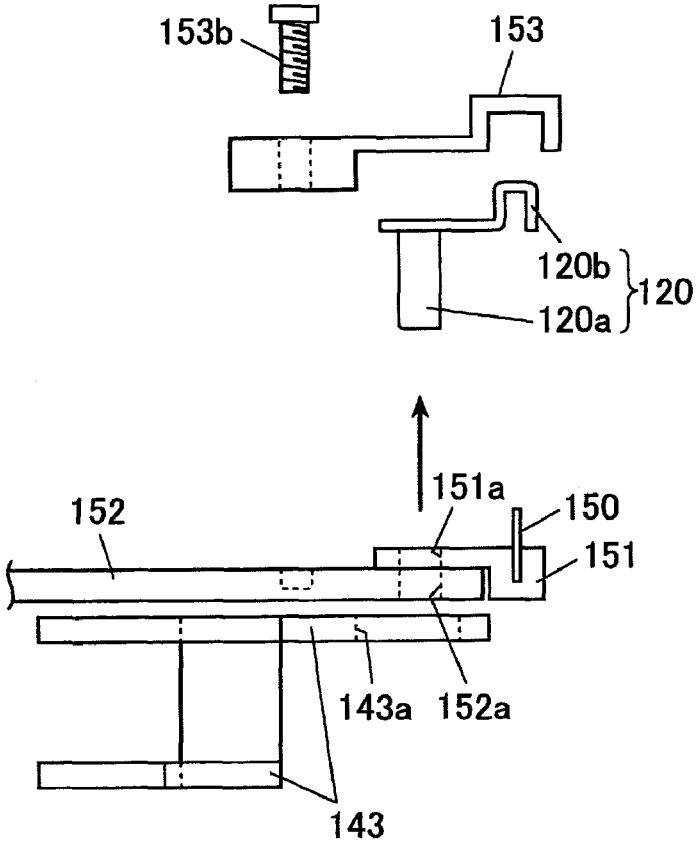
FIG. 4 is another side view of the configuration around the fixed blade.

As shown in FIGS. 3 and 4, the fixed blade 150 is fixedly held by the fixed blade holding member 151. The fixed blade holding member 151 has one side portion form with a groove into which the fixed blade 150 is fixedly fitted and the other end portion formed in a plate shape. The fixed blade holding member 151 is disposed on an upper surface of the attaching plate 152 which is fixed to the frame 10. The attaching plate 152 is disposed between the fixed blade holding member 151 and a link 143. The fixed blade holding member 151 and the attaching plate 152 are formed with insertion holes 151*a*, 152*a* which continuously penetrates through the fixed blade holding member 151 and the attaching plate 152.

The second thread catcher 120 includes a shaft portion 120*a* and a covering portion 120*b* which are integrally formed, and the shaft portion 120 is inserted through the insertion holes 151*a*, 152*a* from above. The link 143, which is positioned below the attaching plate 152, is also formed with an insertion hole 143*a* on a line extending from the insertion holes 151*a*, 152*a*. As shown in FIGS. 3 and 4, the shaft portion 120*a* is inserted through the insertion holes 15 la, 152*a*, 143*a* so as to be movable inside these insertion holes 151*a*, 152*a*, 143*a*. That is, the second thread catcher 120 is provided so as to be movable toward and away with respect to the horizontal shuttle 21.

The covering portion 120*b* is formed at an upper end of the shaft portion 120*a*, and when the shaft portion 120*a* is inserted through the insertion holes 151*a*, 152*a*, 143*a*, the covering portion 120*b* covers the fixed blade 150 from above. Accordingly, the second thread catcher 120 is slidably fitted into the attaching plate 152 from above the attaching plate 152, and is not fixed to the attaching plate 152. That is, the second thread catcher 120 can be removed from the attaching plate 152 by pulling up the second thread catcher 120.

The cover 153 is detachably attached on the upper surface of the attaching plate 152 to cover the second thread catcher 120 from above. The cover 153 is formed to extend along an upper surface shape of the second thread catcher 120. The cover 153 is attached to the attaching plate 152 such that the second thread catcher 120 is slidable with respect to the cover 153 but without jouncing up and down. The cover 153 is attached to the attaching plate 152 with, for example, a screw 153*b*. According to this configuration, even when the second thread catcher 120 tries to upwardly move apart, the cover 153 can contact and hold the second thread catcher 120 from above so as to prevent the shaft portion 120*a* of the second thread catcher 120 from moving out of the insertion holes 151*a*, 152*a*, 143*a*.

As shown in FIG. 5, the attaching plate 152 is formed with a slot 152*a* extending along the longitudinal direction of the first thread catcher 110. The two pins 112 of the first thread catcher 110 are inserted into this slot 152*a*, whereby the movement of the first thread catcher 110 is guided.

As shown in FIG. 2, the driving portion 200 includes a stepping motor 180 serving as a drive source of the catching movement of the first thread catcher 110, a first cam 160 (a thread cutting cam) provided on the lower shaft 2 which is rotated by the sewing machine motor 5, a second cam 170 (a thread catcher drive cam) which is provided in parallel with the first cam 160 and driven by the stepping motor 180, a first link mechanism 130 having a first cam follower 131 which can contact both drivers of the first cam 160 and the second cam 170 and transmitting power for the back and forth movement to the first thread catcher 110 from the first cam 160 and the second cam 170, and a second link mechanism 140 having a second cam follower 141 which can contact both of the drivers the first cam 160 and the second cam 170 and transmitting power for the back and forth movement to the second thread catcher 120 from the first cam 160 and the second cam 170.

Figure 7:
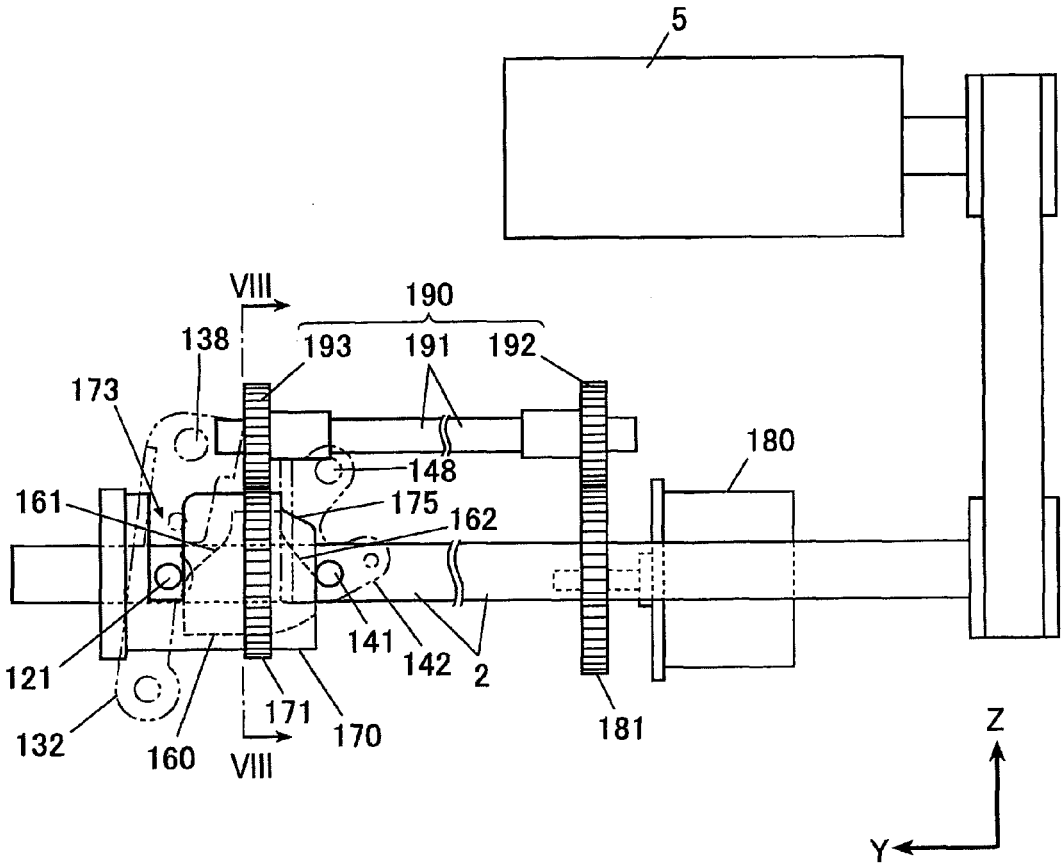
FIG. 7 is a schematic view of a configuration of a portion of the thread cutting device.

As shown in FIGS. 2 and 7, the stepping motor 180 is positioned inside the bed portion 12 on a side of the vertical drum portion 13 (the right side in FIG. 7) and is arranged such that an output shaft thereof extends along the Y-axis direction. One end of a torque transmission shaft 191 extending parallel to the lower shaft 2 is coupled to the output shaft of the stepping motor 180 via gears 181, 192, and another gear 193 is provided on the other end of the torque transmission shaft 191. When the stepping motor 180 is driven, a torque is imparted to the second cam 170 through a power transmission mechanism 190 including the gears 181, 192, the torque transmission shaft 191 and the gear 193.

Figure 9:
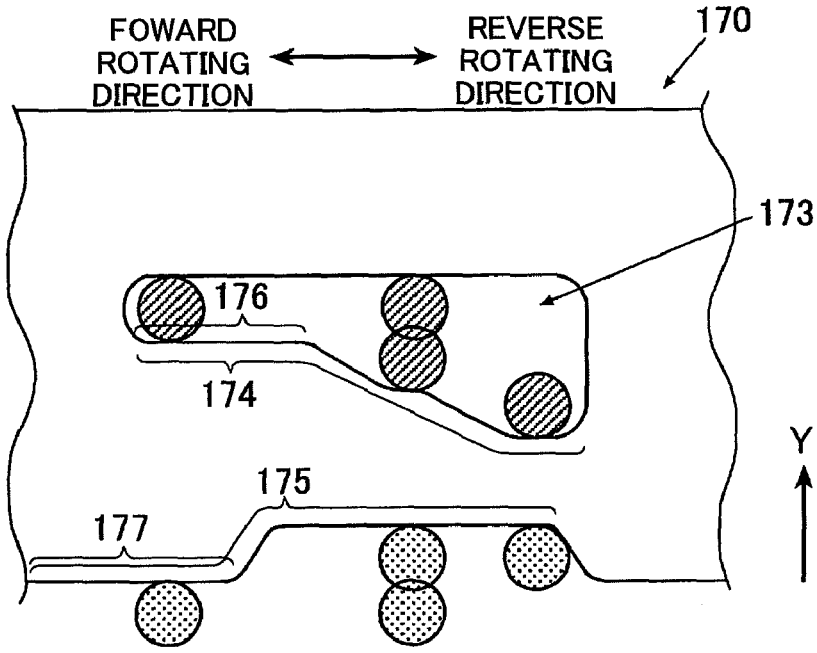
FIG. 9 is a development view illustrating a shape of a thread cutting cam.

In this embodiment, the second cam 170 is rotated to move the first thread catcher 110 and the second thread catcher 120 in their respective forward moving directions C1, D1 when the stepping motor 180 is rotated in a forward rotating direction, and the second cam 170 is rotated to move the first thread catcher 110 and the second thread catcher 120 in their respective backward moving directions C2, D2 when the stepping motor 180 is rotated in a reverse rotating direction (see FIG. 9).

In accordance with the rotations of the second cam 170 around the shaft, the first thread catcher 110 is moved back and forth via the first link mechanism 130 and the second thread catcher 120 is moved back and forth via the second link mechanism 140. A driving amount of the stepping motor 180 corresponding to a rotation amount the second cam 170 around the shaft is empirically obtained in advance as pulse numbers corresponding to various back and forth moving distances, and are stored in a ROM 52 which is a storage unit of the controller 50.

The first cam 160 is an end cam which is fixed to the lower shaft 2 and is rotatable with the lower shaft 2. The first cam 160 has drivers on both end faces in the axial direction of the lower shaft 2, i.e. in the Y-axis direction. An end face of the first cam 160 (the left end face in FIG. 7) on a rear side in the back and forth movement of the first thread catcher 110, i.e. on a tip end side of the bed portion 12 is configured as an end cam portion 161 which engages with the first cam follower 131 of the first link mechanism 130. The other end face (the right end face in FIG. 7) on a side of the vertical drum portion 13 inside the bed portion 12 is configured as another end cam portion 162 which engages with the second cam follower 141 of the second link mechanism 140.

When driven by the sewing machine motor 5, the end cam portions 161, 162 of the first cam 160 guides the cam followers 131, 141 such that the first thread catcher 110 which has caught the thread T is backwardly moved to the rearmost position while keeping the second thread catcher 120 positioned at the foremost position, and then the second thread catcher 120 is backwardly moved to its rearmost position.

Figure 10:
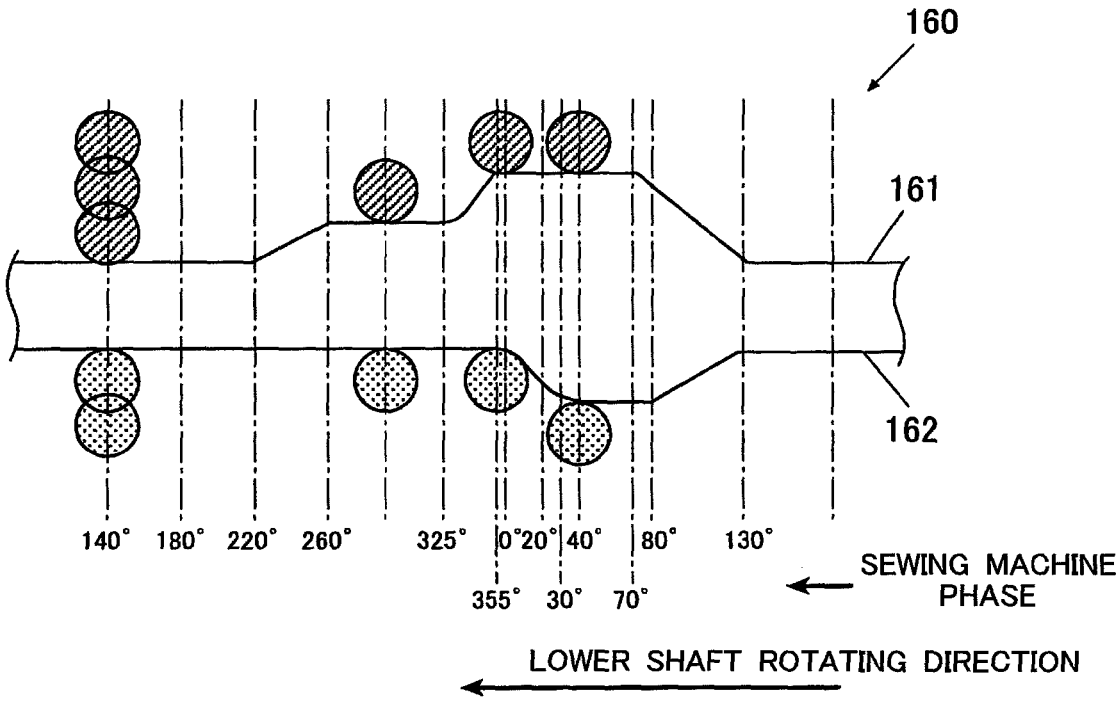
FIG. 10 is a development view illustrating a shape of a thread catcher drive cam.

In detail, end face shapes of the respective end cam portions 161, 162 are curved in a stepwise manner in accordance with respective phases in the rotating direction of the lower shaft 2 (see FIG. 10) so as to guide the cam followers 131, 141 at appropriate timings and with appropriate moving amounts depending on the rotational amount of the lower shaft 2 which is rotated by the controller 50 by driving of the sewing machine motor 5.

Figure 8:
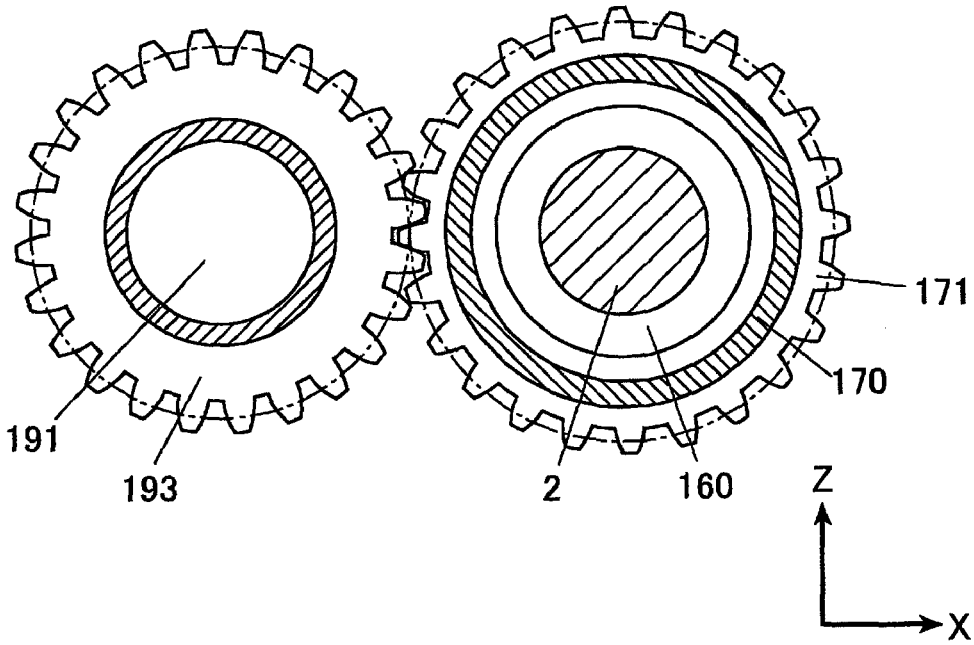
FIG. 8 is a sectional view along the line VIII-VIII in FIG. 7.

The second cam 170 is a cylindrical cam which is arranged such that its axial direction is along the Y-axis direction. The second cam 170 is arranged such that it is concentric with the first cam 160 fixed to the lower shaft 2 and accommodates the first cam 160 thereinside. That is, as shown in FIGS. 7 and 8, the first cam 160 fixed to the lower shaft 2 is rotatably inserted inside the second cam 170 together with the lower shaft 2.

A gear 171 and a flange 172 are provided on the outer peripheral portion of the second cam 170 near the respective end portions in the axial direction. The gear 171 and the flange 172 are brought into contact with respective support members 178 which rotatably support the second cam 170, thereby positioning the second cam 170 with respect to the axial direction. The gear 171 is a driven gear which transmits a rotational force from the stepping motor 180 to the second cam 170.

The second cam 170 is formed with an opening 173 which penetrates through a part of the peripheral surface of the second cam 170. As shown in FIG. 9, an end face of the opening 173 on a side of the gear 171 (a lower side in FIG. 9) is opened in an expanded manner so as to become closer to the gear 171 toward one end side in the circumferential direction of the second cam 171, i.e., toward the reverse rotating direction of the stepping motor 180 (toward the right in FIG. 9). This end face of the opening 173 is configured as a circumferential cam portion 174 having a diagonal portion which is formed to incline with respect to the X-axis direction and the Y-axis direction.

When the second cam 170 is rotated around the Y-axis, the circumferential cam portion 74 moves the first cam follower 131 in the Y-axis direction, while the first cam follower 131 is brought into contact with the circumferential cam portion 174 by a biasing force of a spring 134. The circumferential cam portion 174 has a standby portion 176 formed along the circumferential direction orthogonal to the axial direction of the second cam 170, on the forward rotation side of the stepping motor 180 (the left side in FIG. 9). When the first cam follower 131 of the first link mechanism 130 engages with the standby portion 176, the first thread catcher 110 is positioned at a standby position (see FIG. 13B) which is the rearmost position in its back and forth movement. More specifically, the standby portion 176 moves the first thread catcher 110 backward and moves the first cam follower 131 to a position at which the end cam portion 161 of the first cam 160 and the first cam follower 131 of the first link mechanism 130 are disengaged from each other, and holds the first cam follower 131 at this position. In other words, when the first cam follower 131 is held at the standby portion 176 so that the first thread catcher 10 is positioned at the standby position (see FIG. 13B), the lower shaft 2 and the first cam 160 can freely rotate without being disturbed.

On the other hand, similar to the circumferential cam portion 174, the end cam portion 175 moves the second thread catcher 120 backward to the rearmost position via the second link mechanism 140 and moves the second cam follower 141 to a position at which the end cam portion 162 of the first cam 160 and the second cam follower 141 of the second link mechanism 140 are disengaged from each other, and holds the second cam follower at this position. That is, when the second cam follower 141 is arranged at the standby portion 177 which is formed along the circumferential direction orthogonal to the axial direction and the second thread catcher 120 is arranged at the standby position (see FIG. 13B), the second cam follower 141 and the first cam 160 are disengaged from each other (see FIG. 13A), so that the lower shaft 2 and the first cam 160 can freely rotate without being disturbed.

In other words, the circumferential cam portion 174 and the end cam portion 175 of the second cam 170 are configured to move the first thread catcher 110 and the second thread catcher 120 backward and to move and hold the cam followers 131, 141 at the positions at which the driver of the first cam 160 is disengaged from both the cam followers 131, 141.

Further, the circumferential cam portion 174 and the end cam portion 175 of the second cam 170 move the first thread catcher 110 and the second thread catcher 120 from the rearmost positions to the foremost positions by forward rotation of the stepping motor 180, and then guide the cam followers 131, 141 by reverse rotation of the stepping motor 180 such that the first thread catcher 110 is arranged at a thread catching position which is on the way back to the rearmost position while maintaining the second thread catcher 12 at the foremost position (see FIG. 9).

As shown in FIGS. 2 and 5, the first link mechanism 130 includes a link 132 whose one end is rotatably supported on a base (not shown) which is fixed inside the bed portion 12, a link 133 which is rotatably coupled to the other end portion of the link 132, and a spring 134 which biases the link 132 toward one rotating direction.

One end of the link 132 is supported on a side to the second cam 170 by a pivot 138 whose axial center is in the Z-axis direction, and the other end of the link 132 is horizontally extended above the second cam 170 and is provided so as to be horizontally rotatable around the pivot 138. The rod-shaped first cam follower 131 is extended downward from a central portion in the longitudinal direction of the link 132. The first cam follower 131 has a lower end inserted into the opening 173 of the second cam 170, and contactable with both the circumferential cam 174 of the second cam 170 and the end cam portion 161 of the first cam 160. From the other end of the link 132, a pin 137 is upwardly protruded.

At a central portion in the longitudinal direction of the link 133, a slot 136 which penetrates the link 133 in the Z-axis direction is formed along the longitudinal direction. The link 133 is rotatably coupled to the link 132 via a pin 137 which is slidably fitted in the slot 136. One end of the link 133 on the opposite side of the pivot 138 of the link 132 across the coupling portion to the link 132 is supported on the base (not shown) fixed inside the bed portion 12 rotatably around a pivot 139 along the Z-axis direction so that the link 133 can turn horizontally. At the other end of the link 133, a slot 135 which penetrates the link 133 in the Z-axis direction along the longitudinal direction is formed, and in the slot 135, the pins 112 provided at a lower portion of the first thread catcher 110 is slidably fitted.

The spring 134 biases the link 132 so as to rotate it in the direction A1 (see FIG. 5). In other words, by biasing the first cam follower 131 extending below the link 132 toward the circumferential cam portion 174 and the end cam portion 161 side, the spring 134 biases the first thread catcher 110 coupled to the link 132 via the link 133 in the forward moving direction C1 (the rightward direction in FIG. 5).

The first link mechanism 130 transmits a moving force in the forward moving direction C1 (the rightward direction in FIGS. 5 and 7) to the first thread catcher 110 by an biasing force of the spring 134, and when the first cam 160 or the second cam 170 rotates and the first cam follower 131 is moved to the tip end side of the bed portion 12 (left side in FIG. 5 and FIG. 7) against the biasing force of the spring 134, the first link mechanism transmits a moving force in the backward moving direction C2 to the first thread catcher 110.

As shown in FIGS. 2 and 5, the second link mechanism 140 includes a link 142 whose one end is axially supported so as to turn horizontally at a position more proximal to the stitch point than the first link mechanism 130, a link 143 coupled to the other end of the link 142, and a spring 144 which biases the link 142 toward one rotating direction B1.

The link 142 has a substantially L shape, and one end thereof is supported so as to horizontally rotate around a pivot 148 along the Z-axis direction. The other end of the link 142 is extended horizontally to the upper side of the lower shaft 2 so as to rotate horizontally (FIG. 7). At the other end of the link 142, a pin 147 is provided so as to project upward, and the rod-shaped second cam follower 141 extended downward is provided. The lower end of the second cam follower 141 is extended to the vicinity of the lower shaft 2 and contactable with both the end cam portion 175 of the second cam 170 and the end cam portion 162 of the first cam 160.

The link 143 has a substantially L shape, and is supported at a bent portion of the L shape so as to horizontally rotate around a pivot 149 along the Z-axis direction. At one end of the shorter side of the link 143, a slot 145 along a radial direction around the pivot 149 is formed to penetrate in the Z-axis direction. The link 143 is rotatably coupled to the link 142 via a pin 147 slidably inserted through the slot 145. At the other end of the longer side of the link 143, a slot 143*a* along a radial direction around the pivot 149 penetrates in the Z-axis direction. In the slot 143*a*, a pin 120*a* provided on the lower portion of the second thread catcher 120 is slidably fitted.

The spring 144 biases the link 142 such that it rotates in the direction B1 (see FIG. 5). In other words, the spring 144 biases the second cam follower 141 provided at the lower end of the link 142 toward the end cam portion 145 and the end cam portion 162 side, and biases the second thread catcher 120 coupled to the link 142 via the link 143 in the forward moving direction D1.

The second link mechanism 140 transmits a moving force in the forward moving direction D1 to the second thread catcher 120 by an biasing force of the spring 144, and when the first cam 160 or the second cam 170 rotates and the second cam follower 141 is moved to the vertical drum portion 13 side (to the right in FIGS. 5 and 7) against the biasing force of the spring 144, the second link mechanism transmits a moving force in the backward moving direction D2 to the second thread catcher 120.

Next, a configuration of a control system of the sewing machine 1 will be described in detail with reference to FIG. 11.

Figure 11:
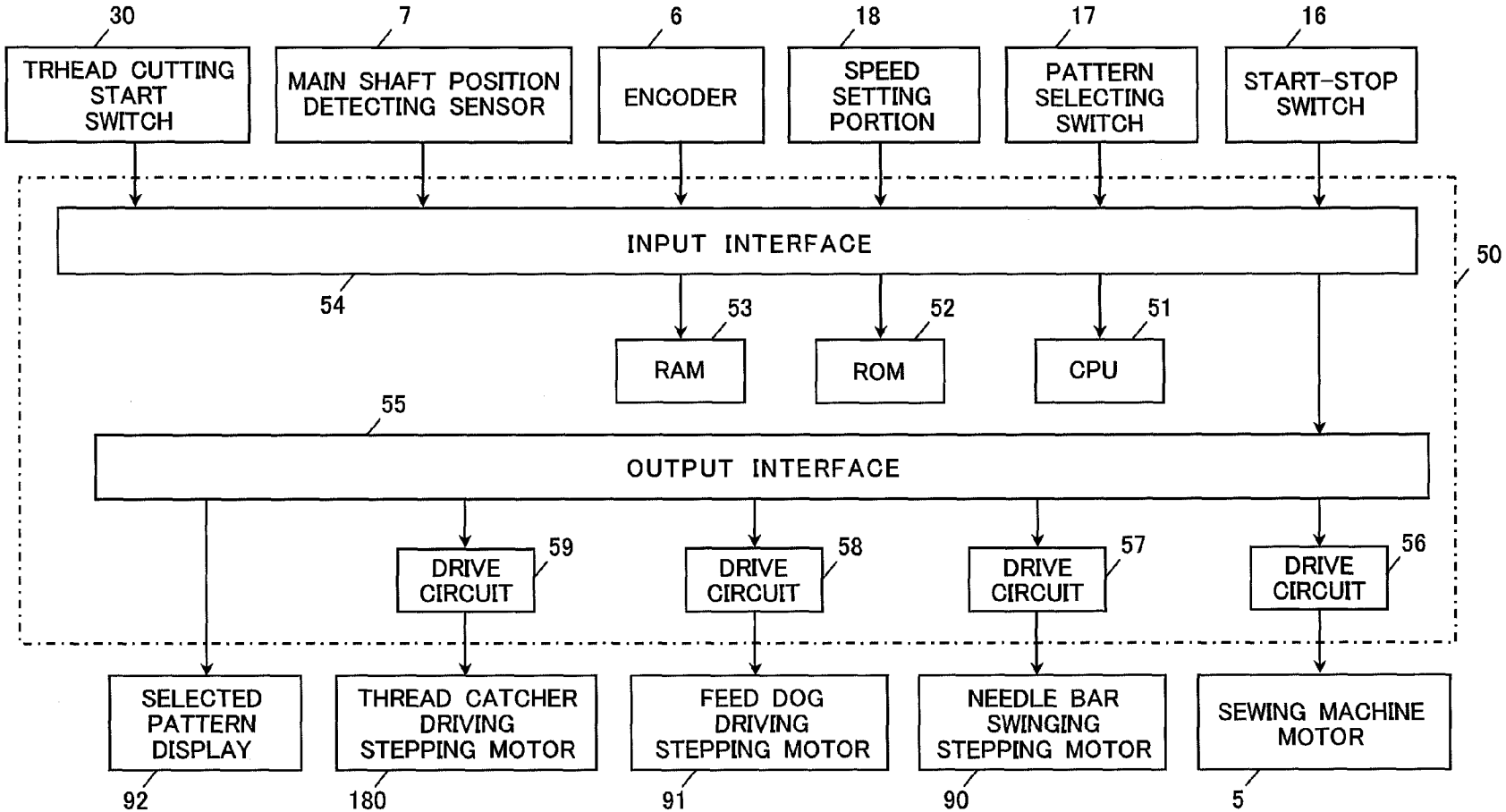
FIG. 11 is a block diagram of an electrical configuration of the sewing machine.
Figure 12:
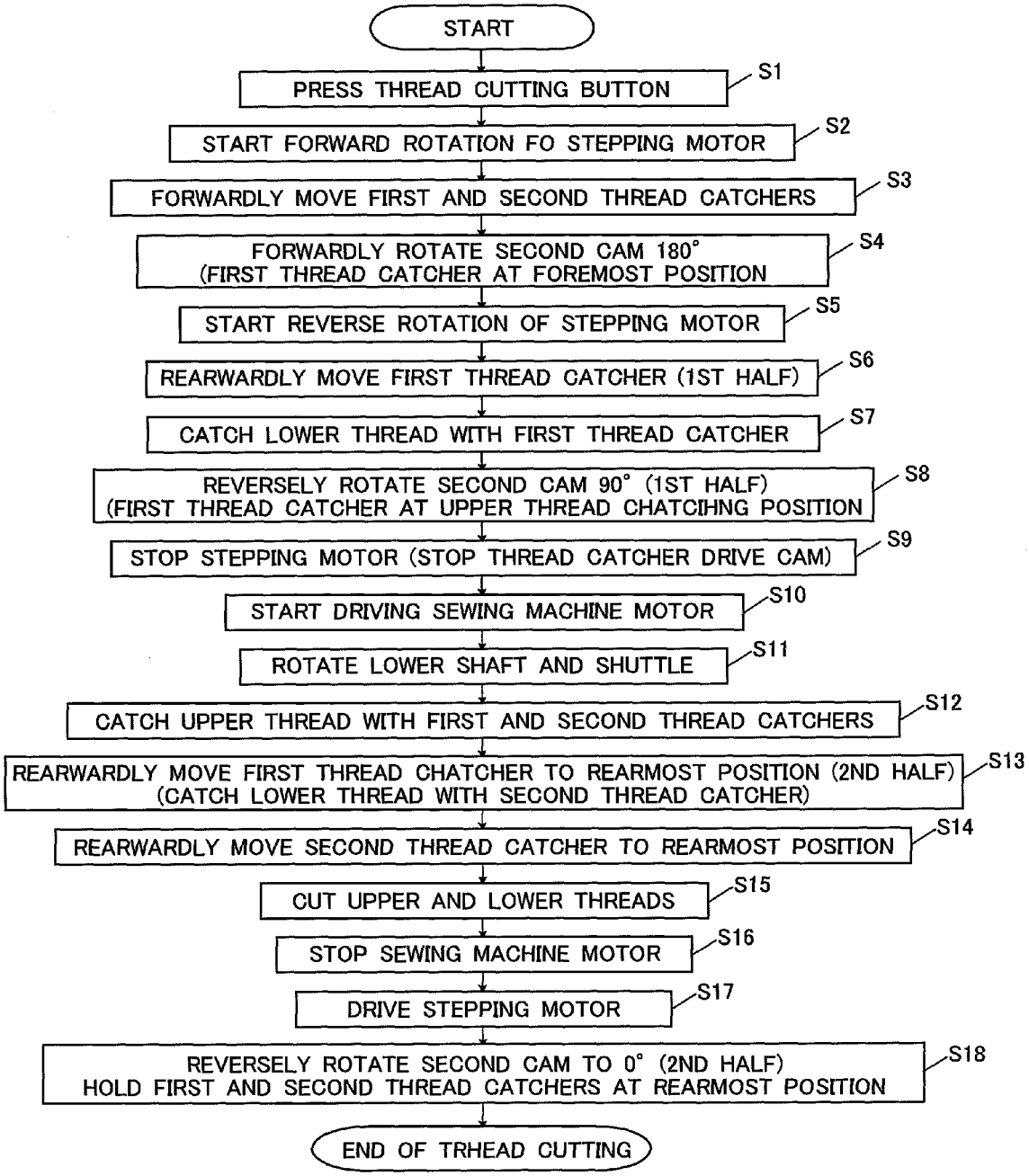
FIG. 12 is a flowchart of an operation of the thread cutting device.

As shown in FIG. 11, the controller 50 includes a ROM 52 in which various programs for performing various controls and processings, sewing data for sewing various patterns and other various setting data are stored, a CPU 51 which executes various programs stored in the ROM 52, a RAM 53 which serves as a work area when executing various programs, an input interface 54 and an output interface 55 coupled to the CPU 51, the ROM 52, and the RAM 53 via buses, a switching drive circuit 56 which performs driving by supplying power to the sewing machine motor 5, a drive circuit 57 which performs driving by supplying power to the needle bar swinging stepping motor 90, a drive circuit 58 which performs driving by supplying power to the feed dog driving stepping motor 91, and a drive circuit 59 which performs driving by supplying power to the thread catcher driving stepping motor 180.

The input interface 54 transmits input signals from the start-stop switch 16, the pattern selecting switch 17, the speed setting portion 18, the encoder 6, and the main shaft position detecting sensor 7 to the CPU 51, and the output interface 55 controls the drive circuits 56, 57, 58, 59 and the selected pattern display 92 according to commands from the CPU 51.

The encoder 6 includes a disk and an optical sensor attached to a rotation shaft of the sewing machine motor 5. The disk has slits opened at regular intervals along the circumference, and the optical sensor includes a light source and a light receiving device which are arranged across the disk. When the upper shaft rotates by 360 degrees, a pulse signal is generated from the light receiving device according to repetition of transmission and blocking of light from the light source. The encoder 6 is designed such that the optical sensor generates, for example, 180 pulses per a 360-degree rotation of the upper shaft. The pulse signal output from the encoder 6 is input into a pulse counter of the input interface 54.

In the controller 50, in response to input signals from the start-stop switch 16, the pattern selecting switch 17, the speed setting portion 18, the encoder 6, and the main shaft position detecting sensor 7, the CPU 51 performs arithmetic processing by using the RAM 53 as a work area based on various control programs stored in the ROM 52, and executes sewing control by driving various actuators of the sewing machine motor 5, the needle bar swinging stepping motor 91, and the feed dog driving stepping motor 91, etc., by outputting output signals corresponding to the arithmetic processing results to the actuators.

Further, the controller 50 of this embodiment functions as a cutting control means for cutting the thread T by moving the second thread catcher 120 by driving the sewing machine motor 5 after capturing the thread T by moving the first thread catcher 110 by driving the stepping motor 180. In detail, when pressing on the thread cutting switch 30 is detected, in the controller 50, the CPU 51 reads a detection signal of the main shaft position detecting sensor 18, and when the lower shaft 2 is positioned at a certain rotational angle (e.g., an angle at which the needle bar is stopped at the lower position), by driving the stepping motor 180 forward, moves the first thread catcher 110 and the second thread catcher 120 from the rearmost positions to the foremost positions. Thereafter, the stepping motor 180 is driven in the reverse direction and while the second thread catcher 120 is left arranged at the foremost position, the first thread catcher 110 is arranged at a thread catching position which is on the way of its backward movement. This control is performed by driving the stepping motor 180 by the CPU 51 so as to rotate the second cam 170 by a predetermined amount around the axis according to the cam shapes (see FIG. 9) of the circumferential cam portion 174 and the end cam portion 175 formed at predetermined phases in the circumferential direction of the second cam 170.

After executing the above-described control, by stopping the stepping motor 180 and driving the sewing machine motor 5, the controller 50 moves the first thread catcher 110 which has caught the thread T back to the rearmost position while the second thread catcher 120 is left arranged at the foremost position, and then moves the second thread catcher 120 to the rearmost position.

Next, based on the flowchart of FIG. 12 and FIG. 13A to FIG. 20, operations of the sewing machine 1 having the above-described configuration will be described. In FIG. 13 to FIG. 20, a thread cutting operation is mainly described, so that some portions of the configuration such as the attaching plate 152, etc., is not shown.

Figure 13A:
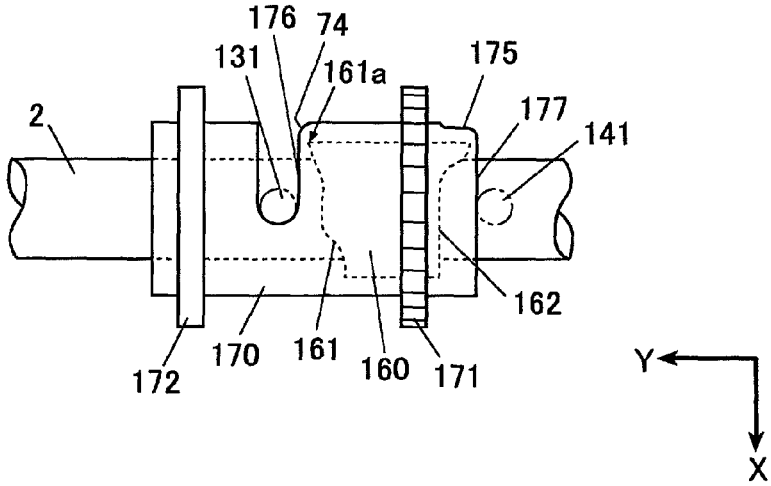
FIG. 13A to FIG. 20 are explanatory views of the operation of the thread cutting device.
Figure 13B:
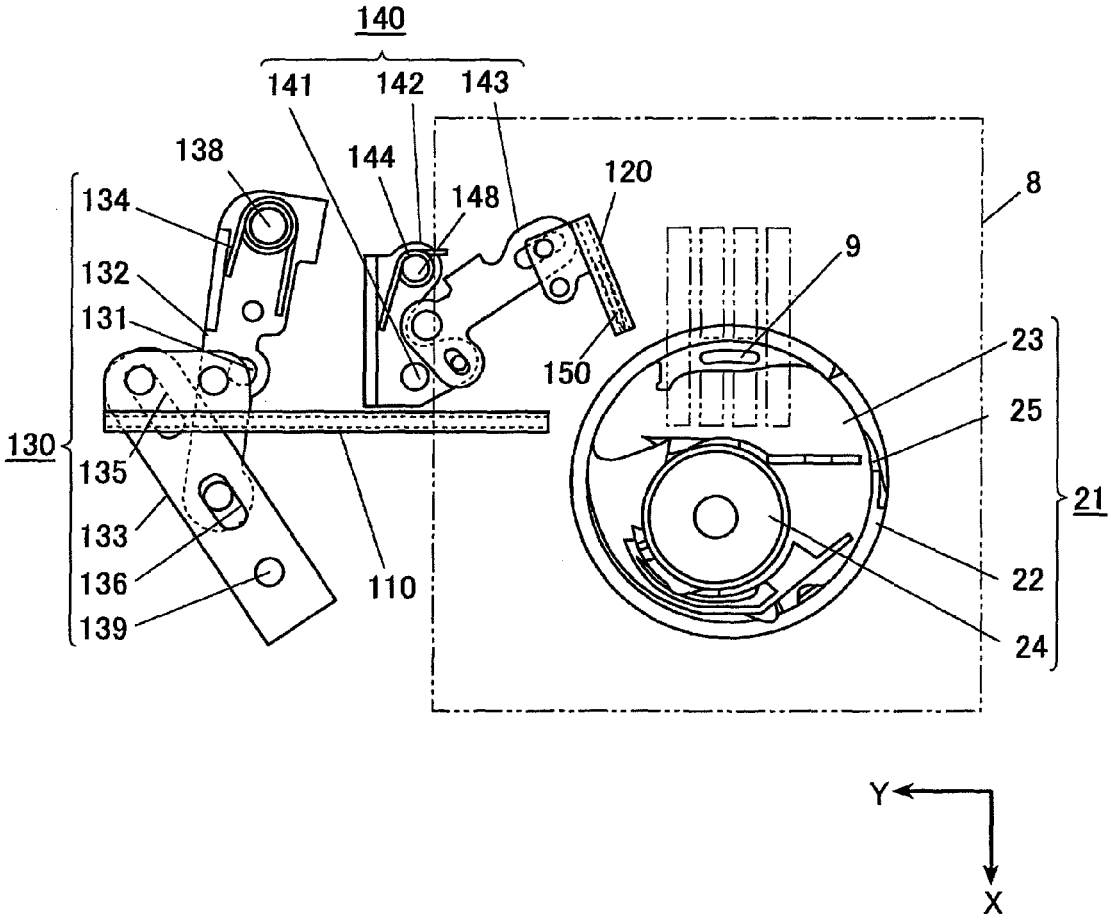

As shown in FIG. 13A, while sewing, the first cam follower 131 of the first link mechanism 130 is arranged at the standby portion 176 of the circumferential cam portion 174 of the second cam 170, and the second cam follower 141 of the second link mechanism 140 is held in a state where it is arranged at the standby portion 177 of the end cam portion 175 of the second cam 170. Therefore, the lower shaft 2 and the first cam 160 rotate without interference between the cam followers 131, 141 and the first cam 160. As shown in FIG. 13B, the first thread catcher 110 and the second thread catcher 120 stand by at the rearmost positions, that is, the standby positions.

Figure 14A:
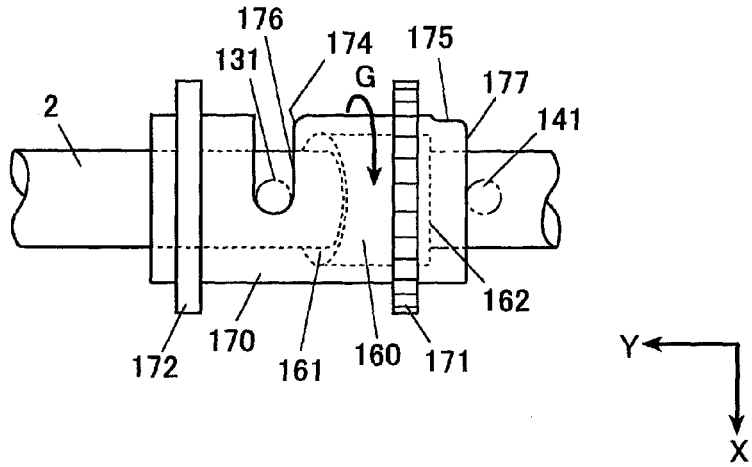
Figure 14B:
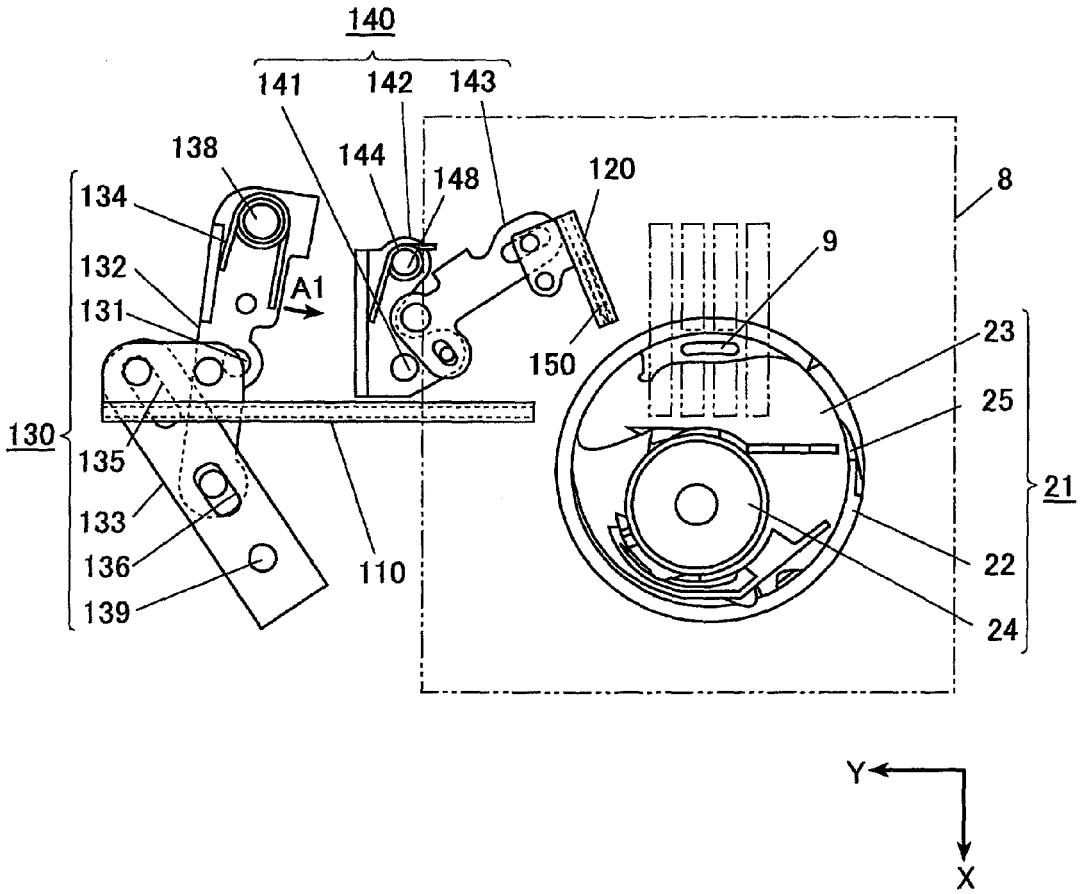

When sewing is finished, the sewing machine motor 5 stops, and the upper shaft and the lower shaft 2 stop in a state where the needle 3 is stopped at the lower position. At this time, as shown in FIG. 14A, the tip end 161*a* of the end cam portion 161 of the first cam 160 is arranged at the opposite side of the first cam follower 131 across the axis line of the lower shaft 2, that is, arranged at the lower side and the first cam is stopped. Accordingly, when the second cam 170 is driven, spaces for allowing the cam followers 131, 141 to move so as to move the first thread catcher 110 and the second thread catcher 120 to the foremost positions are provided. As shown in FIG. 14B, at this time, the first thread catcher 110 and the second thread catcher 120 stand by in a state where they are still arranged at the standby positions.

Next, when the thread cutting button 30 is pressed and a thread cutting operation start signal is detected (Step S1), the CPU 51 drives and rotates the stepping motor 180 forward via the drive circuit 59 (Step S2) to rotate the second cam 170 in the circumferential direction G. Then, the first cam follower 131 in contact with the circumferential cam portion 174 due to the biasing force of the spring 134, is moved rightward in FIGS. 14A and 14B along the circumferential cam portion 174, and the link 132 turns around the pivot 138 in the direction A to forwardly move the first thread catcher 110. Accordingly, the first thread catcher 110 is moved in the forward moving direction C1 (Step S3). According to the rotation of the second cam 170, the second cam follower 141 in contact with the end cam portion 175 due to the biasing force of the spring 144 is moved leftward in FIGS. 14A and 14B along the end cam portion 175. Accordingly, the link 142 is turned around the pivot 148 in the direction of the arrow B1, and the second thread catcher 120 moves in the forward moving direction C1 (Step S3).

Figure 15A:
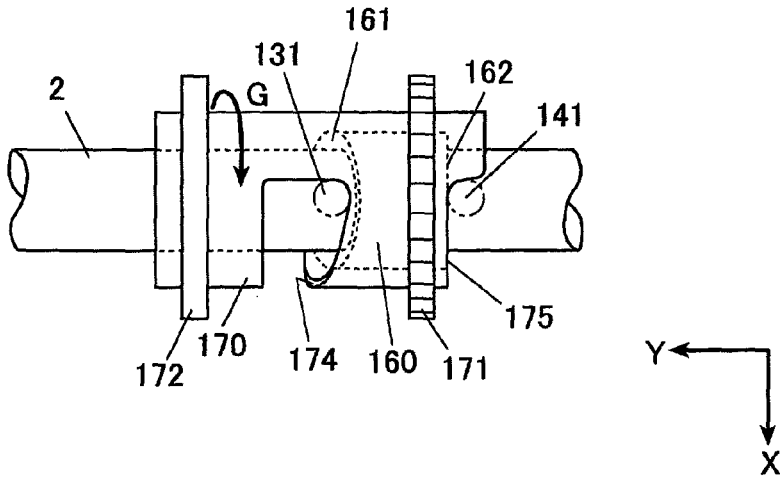
Figure 15B:
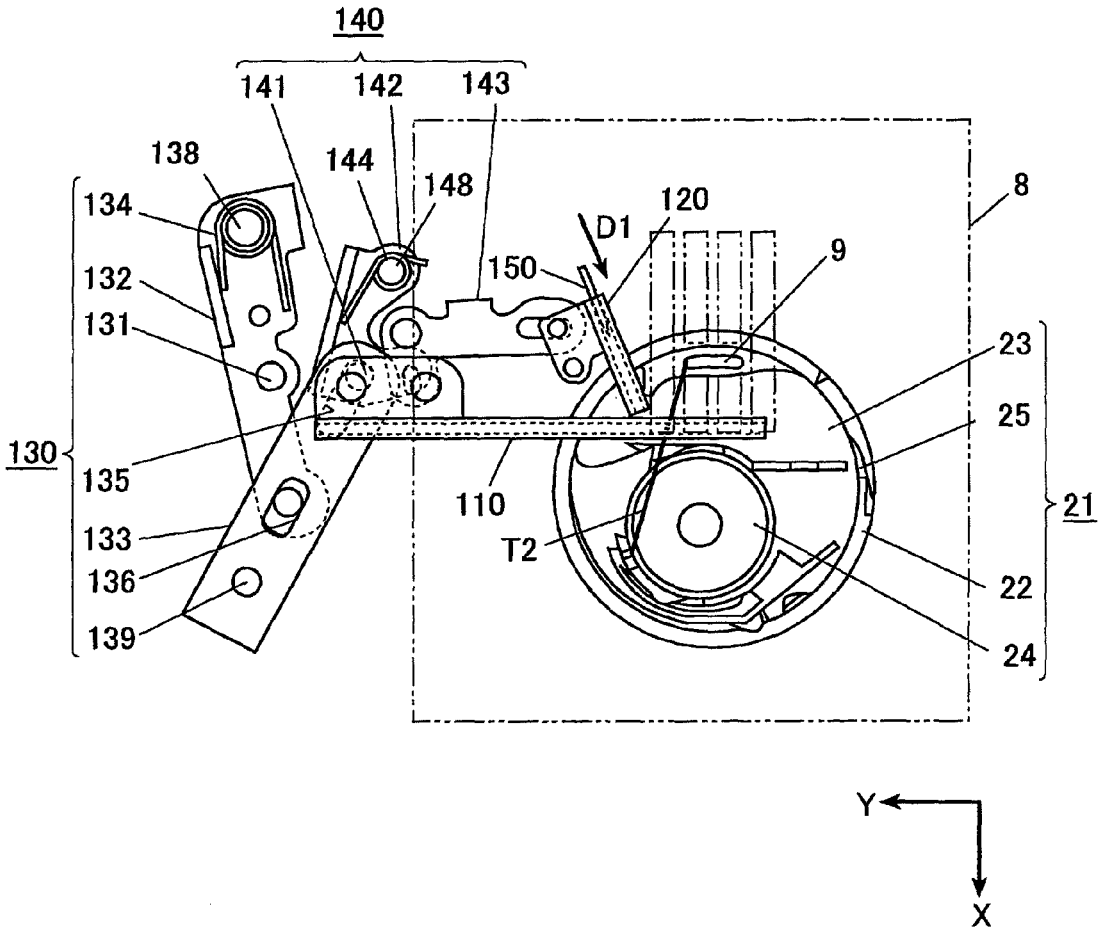

As shown in FIG. 15A, when the stepping motor 180 is driven until the second cam 170 is rotated by 180 degrees in the direction G from its initial position (Step S4), as shown in FIG. 15B, the first thread catcher 110 is moved to the foremost position so that the first thread catching portion 111 passes through the path of the lower thread T2 extending between the bobbin 24 and the needle hole 9 below the throat plate 8. Further, according to the rotation of the second cam 170, the second thread catcher 120 is moved to the foremost position near the stitch point at which the second thread catching portion 111 is close to the first thread catcher 110 above the horizontal shuttle 21 (see FIG. 15B).

Figure 16A:
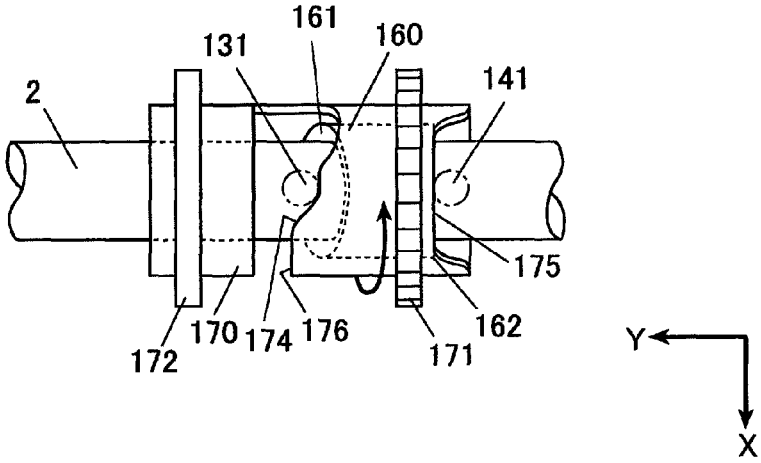
Figure 16B:
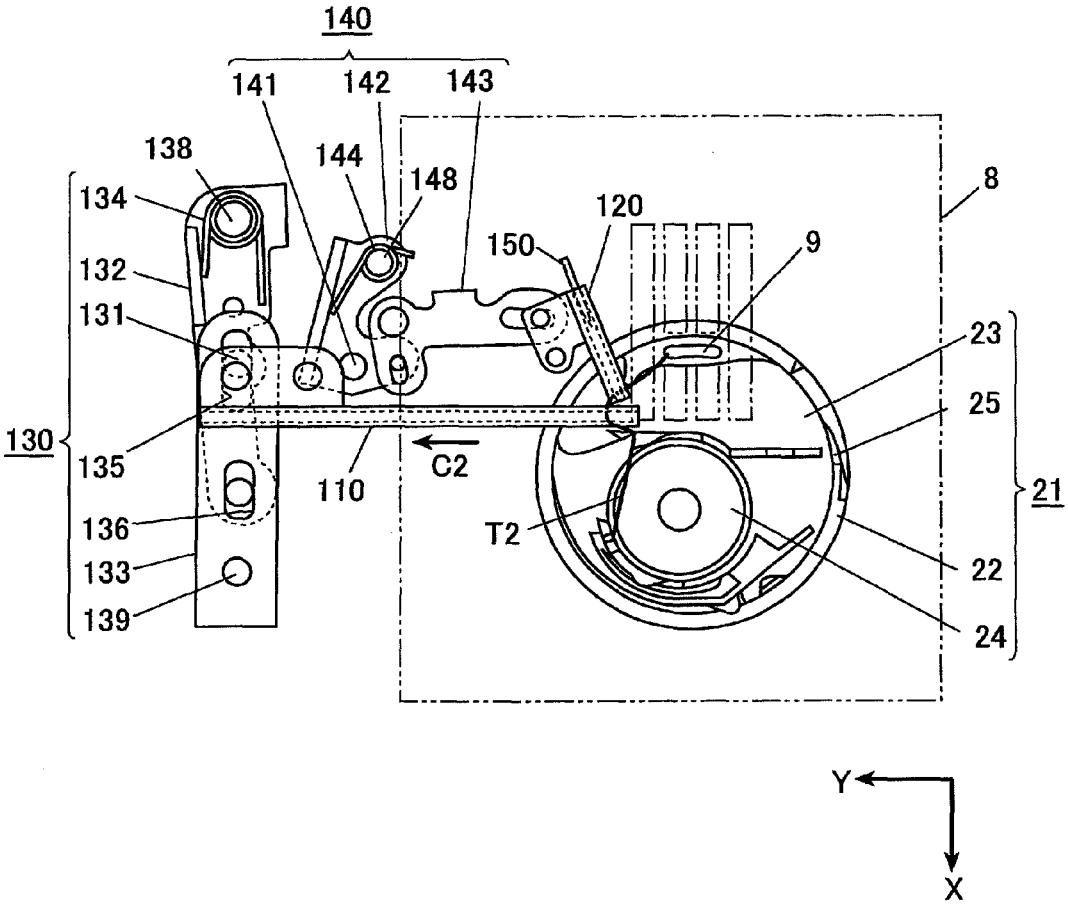

When the first thread catcher 110 is moved to the foremost position, the CPU 51 rotates the second cam 170 in the reverse direction by rotating the stepping motor 180 in the reverse direction at a low speed via the drive circuit 59 (Step S5), and backwardly moves the first thread catcher 110 at a low speed via the first link mechanism 130 (Step S6). Accordingly, the first thread catcher 110 backwardly moves, and the lower thread T2 is caught by the first thread catching portion 111 (step S7), and the lower thread T2 is slowly drawn out of the bobbin 24. As shown in FIG. 16A, when the second cam 170 is rotated in reverse to a position of 90 degrees from its initial position (Step S8), and as shown in FIG. 16B, the first thread catcher 110 moves back to an upper thread catching position which is on the way of its backward movement (first half), the CPU 51 stops the stepping motor 180 via the drive circuit 59 (Step S9), and drives the sewing machine motor 5 via the drive circuit 56 (Step S10). As shown in FIG. 16B, in the state where the stepping motor 180 is stopped in Step S9, the first thread catcher 110 arranged at the upper thread catching position and the second thread catcher 120 arranged at the foremost position are arranged so that their tip ends abut against each other, and the first thread catching portion 111 and the second thread catching portion 111 are arranged close to each other in parallel to each other. In this state, only the lower thread T2 is caught by the first thread catching portion 111, and none of the threads T (T1, T2) are caught by the second thread catching portion 111121.

Figure 17A:
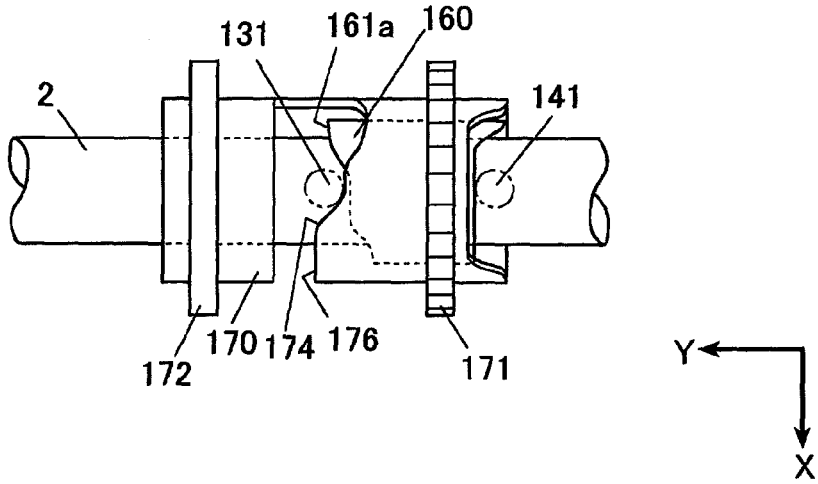
Figure 17B:
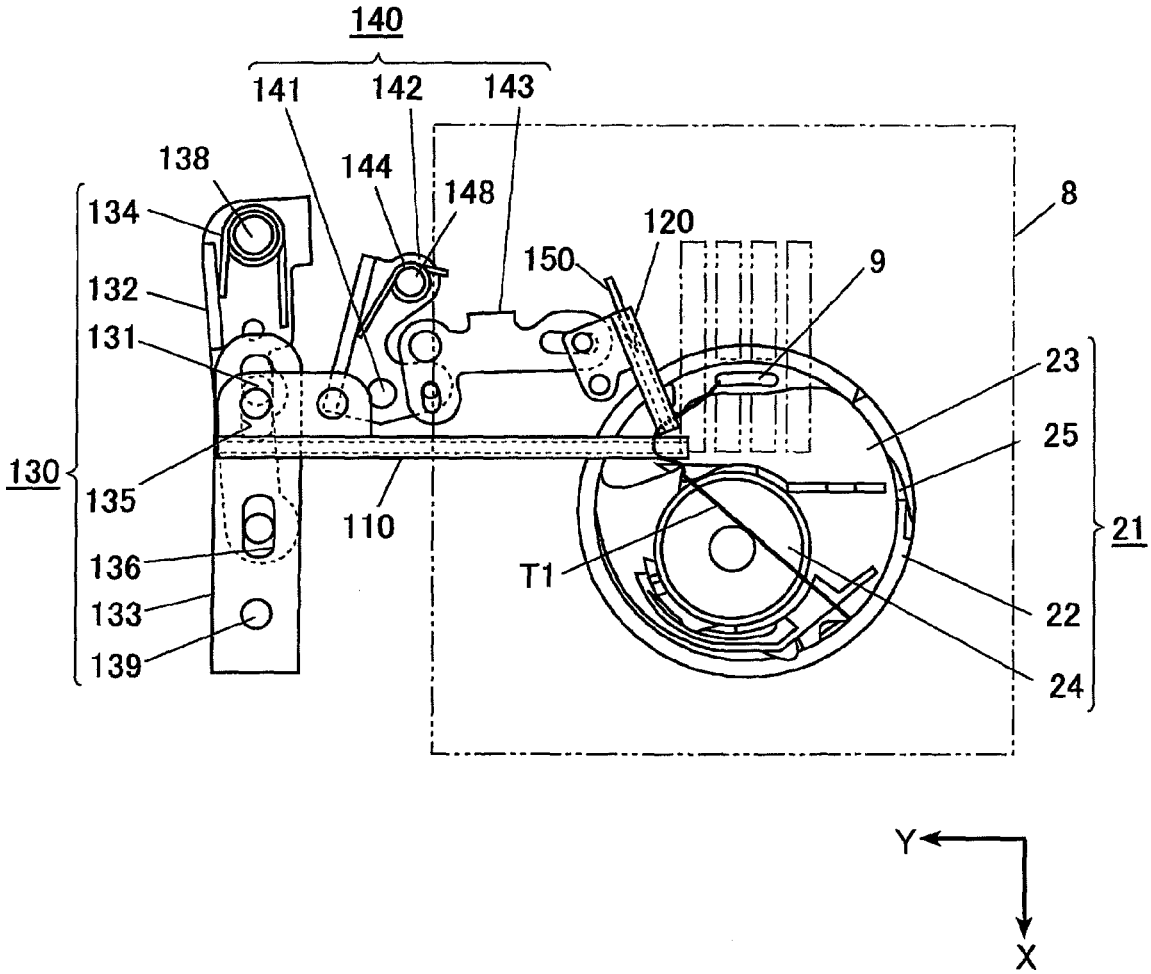
Figure 18A:
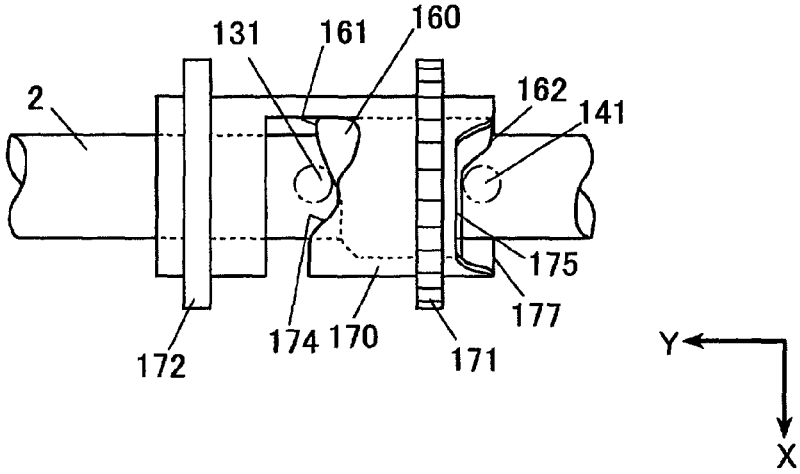
Figure 18B:
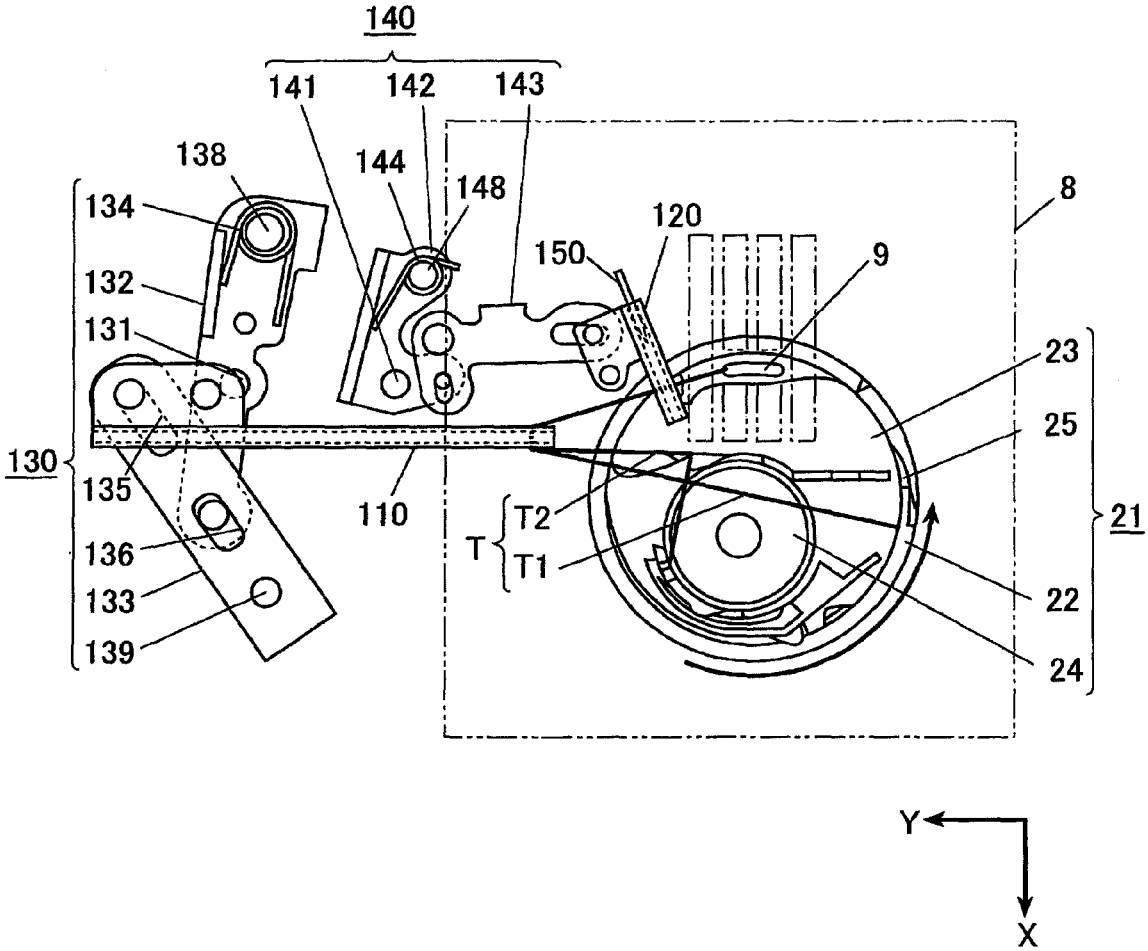

As shown in FIGS. 17A and 18A, when the sewing machine motor 5 is driven, the lower shaft 2 and the first cam 160 rotate, and the horizontal shuttle 32 (the outer shuttle 22) coupled to the lower shaft 2 rotates (Step S11). The horizontal shuttle 21 (the outer shuttle 22) is rotated at a number of rotations twice as many as the number of rotations of the lower shaft 2, and therefore, when the lower shaft 2 rotates by half, that is, by about 180 degrees, the horizontal shuttle 21 (the outer shuttle 22) rotates by nearly 360 degrees, that is, makes a 360-degree rotation. As shown in FIG. 17B, during the half rotation of the lower shaft 2 and the first cam 160, the upper thread T1 which passed through the outer shuttle 22 is caught concurrently by the thread catching portions 111 and 121 of the thread catchers 110 and 120 (Step S12). In other words, at this time, the upper thread T1 and the lower thread T2 are caught by the first thread catching portion 111, and the upper thread T1 is caught by the second thread catching portion 111. As shown in FIG. 18A, when the end cam portion 161 of the first cam 160 rotates to a position at which it comes into contact with the first cam follower 131, the first cam follower 131 is moved leftward along the end cam portion 161. Along with this, the first thread catcher 110 further moves backward (second half).

Figure 20:
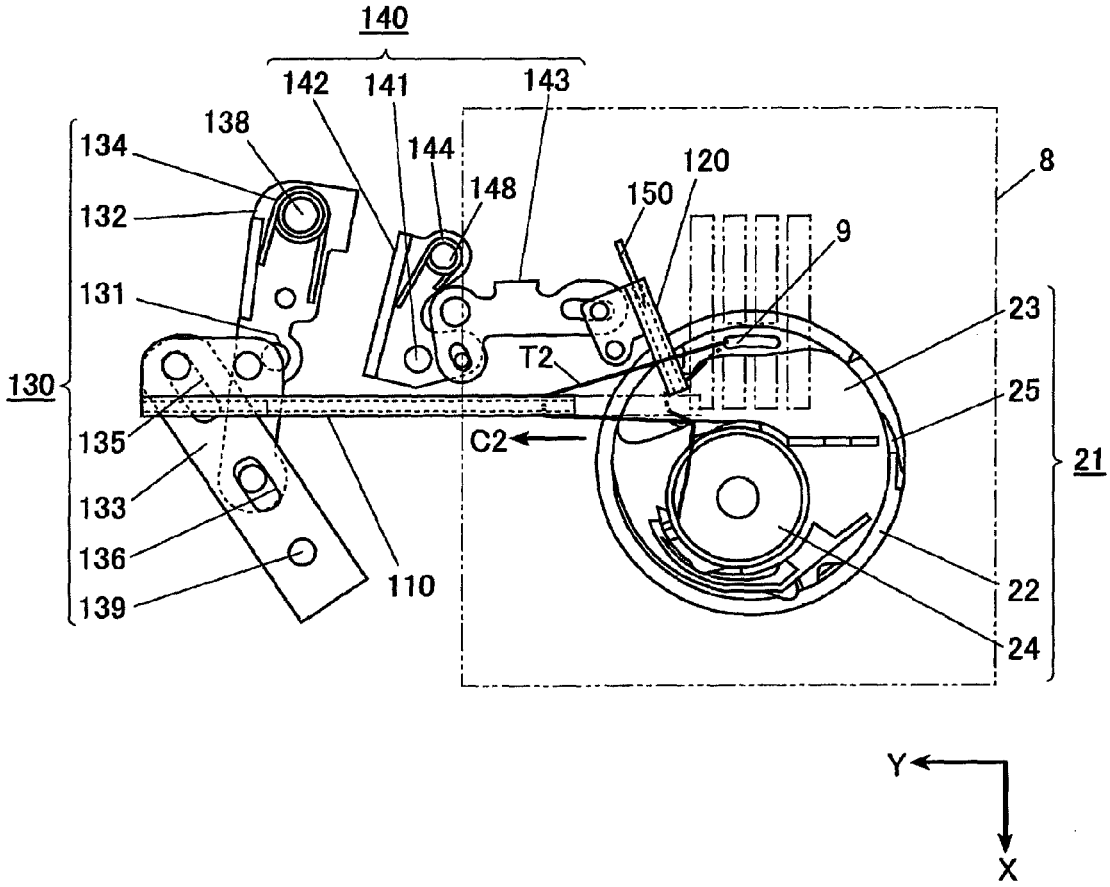
Figure 21:
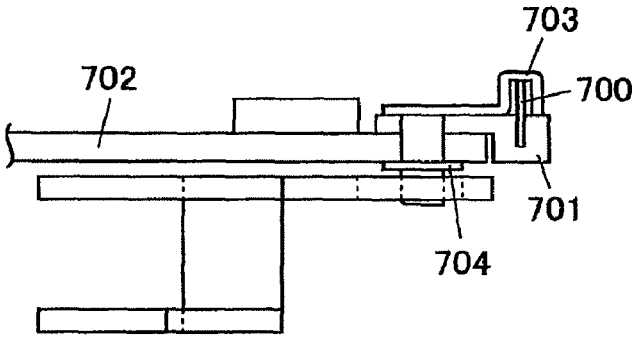
PRIOR ART FIG. 21
FIG. 21 is a side view of a configuration around a fixed blade of a related art thread cutting device.

As shown in FIG. 20, by moving the first thread catcher 110 backward from the upper thread catching position to the rearmost position, among the upper thread T1 and the lower thread T2 caught by the first thread catching portion 111, an angle of the lower thread T2 extending between the second thread catching portion 111 and the needle hole 9 changes. In other words, according to the backward movement of the first thread catcher 110 (second half), the lower thread T2 extending between the first thread catching portion 111 and the needle hole 9 changes so as to become nearly parallel to the Y-axis direction around the needle hole 9 in the plan view.

According to the angle change of the lower thread T2, the lower thread T2 is guided downward along the curved surface on the tip end of the second thread catcher 120 and caught by the second thread catching portion 111. Therefore, in the state where the first thread catcher 110 is arranged at the rearmost position shown in FIG. 18B, the upper thread T1 and the lower thread T2 are caught by the first thread catching portion 111, and the upper thread T1 and the lower thread T2 are also caught by the second thread catching portion 111 (Step S13).

Figure 19A:
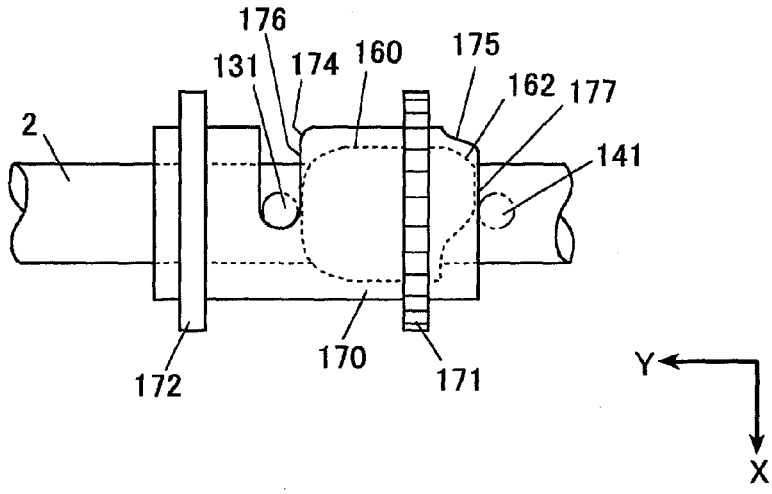
Figure 19B:
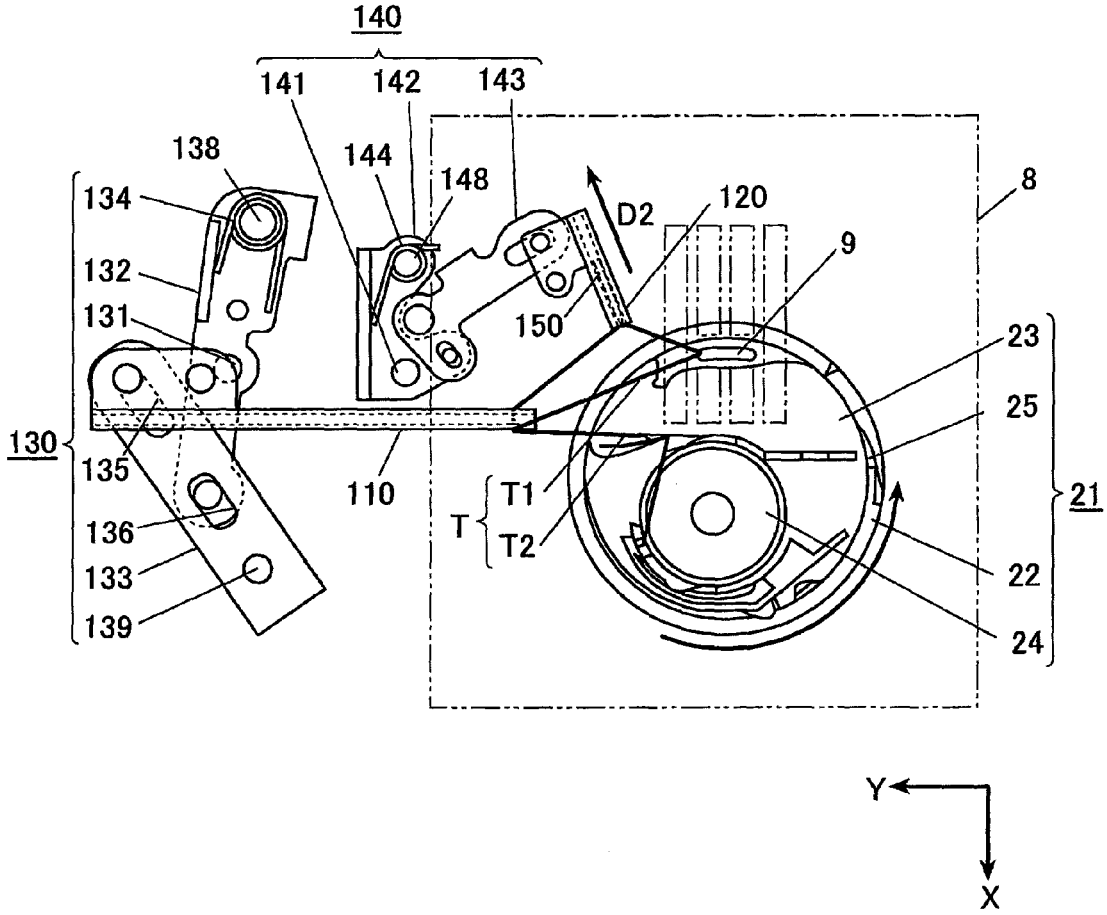

As shown in FIG. 19B, the second thread catching portion 111 of the second thread catcher 120 passes through the thread cutting position and further moves back to the rearmost position (Step S14), and the upper thread T1 and the lower thread T2 which are thereby guided to the fixed blade 150 by the second thread catching portion 111 are cut (Step S15).

Thereafter, as shown in FIG. 19A, when the lower shaft 2 and the first cam 160 rotate by 180 degrees, the first cam follower 131 is guided to the tip end 161*a* of the end cam portion 161 of the first cam 160, and the first thread catcher 110 is moved back to the vicinity of the standby position which is the initial position. Further, the second cam follower 141 is guided to the tip end of the end cam portion 162 of the first cam 160, and the second thread catcher 120 is moved back to the vicinity of the standby position which is the initial position.

Further, the CPU 51 stops the sewing machine motor 5 via the drive circuit 56 (Step S16), and then restarts the reverse rotation driving of the stepping motor 180 (second half) via the drive circuit 59 to execute processing for driving the second cam 170 in reverse (rerotating direction) to the origin position (Step S17). Accordingly, the second cam 170 rotates in reverse to the initial position (0 degrees), the first cam follower 131 is guided into the standby portion 176 of the circumferential cam portion 174, and the second cam follower 141 is guided to the standby portion 177 of the end cam portion 175. Therefore, both the first thread catcher 110 and the second thread catcher 120 are held at the rearmost positions (Step S18), and a state enabling sewing is established, and then the thread cutting processing is ended.

Next, an operation for replacing the fixed blade 150 will be described.

To replace the fixed blade 150, after stopping driving of the sewing machine 1, the throat plate 8 is removed. When the throat plate 8 is removed, the cover 153 which is positioned the highest appears.

Then, when the screw 153*b* is removed from the attaching plate 152 and the cover 153 which positioned the highest is removed, the second thread catcher 120 below the cover 153 appears. At this time, the second thread catcher 120 is released from the held state by the cover 153. Therefore, after removing the cover 153, by directly pulling the second thread catcher 120 upward and removing it, the fixed blade 150 appears.

Next, the fixed blade 150 is removed from the fixed blade holding member 151, and a new fixed blade 150 is securely fixed to the fixed blade holding member 151. After the fixed blade 150 is replaced, in the order reverse to the above-described order, the second thread catcher 120 is covered on the fixed blade 150 from above and the shaft portion 120*a* is inserted into the insertion holes 151*a*, 152*a*, 143*a*. Then, from above the second thread catcher 120, the cover 153 is covered and the cover 153 is attached to the attaching plate 152 with the screw 153*b*.

Thus, according to the thread cutting device 100, when replacing the fixed blade 150, by removing the cover 153 which is positioned the highest, the second thread catcher 120 below the cover 153 appears, and the second thread catcher 120 is released from the pressed state by the cover 153. Therefore, after removing the cover 153, by directly pulling up the second thread catcher 120 and removing it, the fixed blade 150 is exposed to the outside. In other words, even without removing the entire unit including various components of the thread cutting device, the fixed blade 150 can be replaced, so that the fixed blade 150 can be easily replaced.

By attaching the cover 153 to the attaching plate 152, the fixed blade 150 can be replaced only by removing the throat plate 81 above the fixed blade 150, and the operability is further improved.

Further, in the above-described embodiment, the cover 153 is attached to the attaching plate 152, however, the cover 153 may be attached to the back surface of the throat plate 8. In this case, the cover 153 holds the second thread catcher 120 from above when the throat plate 8 is attached to the sewing machine bed.

What is claimed is:

1. A thread cutting device of a sewing machine, the thread cutting device operable to cut a thread below a throat plate through which a needle is inserted, the thread cutting device comprising:

a first thread catcher operable to catch the thread;

a second thread catcher operable to catch the thread that is caught by the first thread catcher;

a fixed blade operable to cut the thread that is caught by the second thread catcher;

a driving portion which drives the first thread catcher and the second thread catcher such that the second thread catcher catches the thread that is caught by the first thread catcher and guides the thread toward the fixed blade;

an attaching member with respect to which the fixed blade is fixed and into which the second thread catcher is slidably inserted from above over the fixed blade; and a cover which covers the second thread catcher from above so as to restrict an upward movement of the second thread catcher.

2. The thread cutting device according to claim 1, wherein the cover is detachably attached to the attaching member.

3. The thread cutting device according to claim 1, wherein the first thread catcher comprises a thread catching portion operable to move back and forth with respect to a region below the throat plate and to catch the thread when moving backward from the region below the throat plate, and the second thread catcher, the fixed blade and the cover are arranged within the region below the throat plate.

4. The thread cutting device according to claim 1, further comprising a holding member which fixedly holds the fixed blade, wherein the holding member is arranged on an upper surface of the attaching member, and the second thread catcher is slidably inserted into the holding member from above.

5. The thread cutting device according to claim 1, wherein the second thread catcher comprises:

a covering portion which covers the fixed blade from above; and a shaft portion which is slidably inserted into the attaching member.

6. The thread cutting device according to claim 1, wherein the cover is formed along an upper surface shape of the second thread catcher.

* * * * *